US009931743B2

(12) United States Patent
Lau et al.

(10) Patent No.: US 9,931,743 B2
(45) Date of Patent: Apr. 3, 2018

(54) MULTI-FUNCTION TOOL SYSTEM

(71) Applicant: Techtronic Power Tools Technology Limited, Tortola (VG)

(72) Inventors: Siu Yan Lau, Fanling (CN); Jason P. Whitmire, Greenville, SC (US); Jason Brandenburg, Anderson, SC (US); Thomas Parel, Anderson, SC (US); Taku Ohi, Greer, SC (US)

(73) Assignee: TECHTRONIC POWER TOOLS TECHNOLOGY LIMITED, Tortola (VG)

( * ) Notice: Subject to any disclaimer, the term of this patent is extended or adjusted under 35 U.S.C. 154(b) by 418 days.

(21) Appl. No.: 14/792,829

(22) Filed: Jul. 7, 2015

(65) Prior Publication Data

US 2015/0306756 A1 Oct. 29, 2015

Related U.S. Application Data

(60) Division of application No. 14/188,869, filed on Feb. 25, 2014, now Pat. No. 9,085,077, which is a continuation of application No. 12/971,049, filed on Dec. 17, 2010, now Pat. No. 8,695,725.

(60) Provisional application No. 61/287,940, filed on Dec. 18, 2009.

(51) Int. Cl.
*B25F 3/00* (2006.01)
*B25F 5/02* (2006.01)

(52) U.S. Cl.
CPC ..... *B25F 3/00* (2013.01); *B25F 5/02* (2013.01); *Y10T 29/49876* (2015.01); *Y10T 403/68* (2015.01); *Y10T 403/69* (2015.01)

(58) Field of Classification Search
CPC . B25F 3/00; B25F 5/02; Y01T 403/68; Y01T 403/69
USPC ..... 173/170
See application file for complete search history.

(56) References Cited

U.S. PATENT DOCUMENTS

| | | | |
|---|---|---|---|
| 2,539,387 | A | 1/1951 | Alden |
| 2,726,689 | A | 12/1955 | Busby |
| 2,808,085 | A | 10/1957 | Hollien et al. |
| 2,808,749 | A | 10/1957 | Lampke |
| 3,009,493 | A | 11/1961 | Dodegge |

(Continued)

FOREIGN PATENT DOCUMENTS

| | | |
|---|---|---|
| CN | 1572403 | 2/2005 |
| CN | 201049456 | 4/2008 |

(Continued)

*Primary Examiner* — Michelle Lopez
(74) *Attorney, Agent, or Firm* — Michael Best & Friedrich LLP

(57) ABSTRACT

A power tool having a removable head, a motor, a trigger, and a trigger stop movable between first and second positions. In the second position the trigger is unlocked to permit activation of the motor. A linkage is coupled to the trigger stop and is positioned at a first radial distance from the first central axis. A plurality of actuators extend from the head and are positioned at a second radial distance substantially equal to the first radial distance. When the head is coupled to the handle in a first rotational orientation, one of the plurality of actuators engages the linkage to move the trigger stop to the second position, and when the head is coupled to the handle in a second rotational orientation different from the first rotational orientation, another one of the plurality of actuators engages the linkage to move the trigger stop to the second position.

5 Claims, 25 Drawing Sheets

(56) References Cited

U.S. PATENT DOCUMENTS

| | | | |
|---|---|---|---|
| 3,260,541 | A | 7/1966 | Sadler et al. |
| 3,574,374 | A | 4/1971 | Keller et al. |
| 3,703,089 | A | 11/1972 | Geisthoff et al. |
| 3,724,237 | A | 4/1973 | Wood |
| 3,734,515 | A | 5/1973 | Dudek |
| 3,759,336 | A | 9/1973 | Marcovitz et al. |
| 3,952,239 | A | 4/1976 | Owings et al. |
| 4,078,589 | A | 3/1978 | Miller |
| RE30,680 | E | 7/1981 | Kress et al. |
| 4,346,630 | A | 8/1982 | Hanson |
| 4,392,836 | A | 7/1983 | Sugawara |
| 4,448,098 | A | 5/1984 | Totsu |
| 4,524,649 | A | 6/1985 | Diaz et al. |
| 4,639,163 | A | 1/1987 | Buthe et al. |
| 4,813,808 | A | 3/1989 | Gehrke |
| 4,974,475 | A | 12/1990 | Lord et al. |
| 5,033,552 | A | 7/1991 | Hu |
| 5,052,496 | A | 10/1991 | Albert et al. |
| 5,170,851 | A | 12/1992 | Kress et al. |
| 5,562,015 | A | 10/1996 | Zinck |
| 5,771,516 | A | 6/1998 | Huang |
| 5,993,454 | A | 11/1999 | Longo |
| D420,267 | S | 2/2000 | Robson |
| 6,039,126 | A | 3/2000 | Hsieh |
| 6,153,838 | A | 11/2000 | Wadge |
| 6,170,579 | B1 | 1/2001 | Wadge |
| 6,176,322 | B1 | 1/2001 | Wadge |
| 6,206,107 | B1 | 3/2001 | Wadge |
| 6,263,979 | B1 | 7/2001 | Dyke et al. |
| 6,263,980 | B1 | 7/2001 | Wadge |
| D447,035 | S | 8/2001 | Netzler |
| 6,286,611 | B1 | 9/2001 | Bone |
| D449,212 | S | 10/2001 | Proce et al. |
| 6,352,127 | B1 | 3/2002 | Yorde |
| 6,553,642 | B2 | 4/2003 | Driessen |
| 6,568,298 | B1 | 5/2003 | Zinck |
| 6,634,439 | B2 | 10/2003 | Driessen |
| 6,641,467 | B1 | 11/2003 | Robson et al. |
| 6,675,911 | B2 | 1/2004 | Driessen |
| 6,712,368 | B2 | 3/2004 | Bohn et al. |
| 6,715,380 | B2 | 4/2004 | Listl et al. |
| 6,789,447 | B1 | 9/2004 | Zinck |
| 6,789,448 | B2 | 9/2004 | Ono et al. |
| 6,915,721 | B2 | 7/2005 | Hsu et al. |
| 7,021,399 | B2 | 4/2006 | Driessen |
| 7,063,170 | B2 | 6/2006 | Ortt et al. |
| 7,069,816 | B1 | 7/2006 | Saathoff et al. |
| 7,077,736 | B2 | 7/2006 | Uzumcu et al. |
| 7,100,705 | B2 | 9/2006 | Ortt et al. |
| 7,137,457 | B2 | 11/2006 | Frauhammer et al. |
| D533,041 | S | 12/2006 | Pozgay et al. |
| 7,273,159 | B2 | 9/2007 | Brotto |
| D554,461 | S | 11/2007 | Kokawa et al. |
| 7,306,050 | B2 | 12/2007 | Chen |
| 7,413,025 | B2 | 8/2008 | Provost |
| D580,247 | S | 11/2008 | Taniguchi et al. |
| D587,978 | S | 3/2009 | Aglassing |
| D588,891 | S | 3/2009 | Hayakawa et al. |
| 7,509,894 | B2 | 3/2009 | Chen |
| 7,549,953 | B2 | 6/2009 | Walters |
| 7,568,288 | B2 | 8/2009 | Baker |
| 7,578,730 | B2 | 8/2009 | Chen |
| 7,596,872 | B2 | 10/2009 | Clarke et al. |
| D626,398 | S | 10/2010 | Lau et al. |
| D626,395 | S | 11/2010 | Lau et al. |
| 8,695,725 | B2 | 4/2014 | Lau et al. |
| 9,085,077 | B2 | 7/2015 | Lau et al. |
| 2002/0020539 | A1 | 2/2002 | Driessen |
| 2002/0148623 | A1 | 10/2002 | Pan |
| 2004/0103761 | A1 | 6/2004 | Pillow |
| 2007/0193761 | A1 | 8/2007 | Brotto |
| 2007/0240892 | A1 | 10/2007 | Brotto et al. |
| 2008/0136125 | A1 | 6/2008 | Hirt et al. |
| 2009/0272554 | A1 | 11/2009 | Young et al. |

FOREIGN PATENT DOCUMENTS

| | | |
|---|---|---|
| EP | 1129825 | 5/2001 |
| WO | 2008/057023 | 5/2008 |

MULTI-FUNCTION TOOL SYSTEM

CROSS REFERENCE TO RELATED APPLICATION

This application is a divisional of U.S. patent application Ser. No. 14/188,869, filed Feb. 25, 2014, now U.S. Pat. No. 9,085,077, which is a continuation of U.S. patent application Ser. No. 12/971,049, filed Dec. 17, 2010, now U.S. Pat. No. 8,695,725, which claims priority to U.S. Provisional Patent Application No. 61/287,940, filed Dec. 18, 2009. The entire contents of all these applications are incorporated herein by reference.

BACKGROUND

The present invention relates to power tools driven by an electric motor. Power tools utilize the rotation of an electric motor to provide useful torque for operations such as drilling, driving fasteners, and the like.

An example of a power tool system having a tool body and interchangeable tool heads is shown in U.S. Pat. No. 6,176,322. The electric motor is housed in the tool body, and the tool heads are each selectively connectible to the tool body to be driven by the motor. Each tool head connects to the tool body in a single rotational orientation with respect to the tool body. The tool body is bulky and utilizes space inefficiently, having an oblong ring shape with a trigger disposed on an inner surface of the ring shape.

SUMMARY

In one aspect, the invention provides a power tool handle selectively connectable to a power tool head. The power tool handle includes a handle including a grip portion, the grip portion defining a longitudinal axis, and a motor housed within the handle and including a drive shaft driven by the motor, the drive shaft mounted for rotation within the handle and defining an axis of rotation substantially parallel to the longitudinal axis of the handle. The power tool handle also includes a trigger disposed proximate the grip portion of the handle for actuating the motor, and a button disposed on the power tool handle and movable in a direction defining an axis substantially parallel to the longitudinal axis, the button movable to a first position by the tool head when the tool head is coupled to the handle and movable to a second position when the tool head is removed from the handle. In the first position, the trigger can actuate the motor, and in the second position, the trigger is inhibited from actuating the motor.

In another aspect, the invention provides a power tool. The power tool includes a handle including a grip portion, the grip portion defining a longitudinal axis, a motor housed within the handle and including a drive shaft driven by the motor, the drive shaft journalled for rotation within the handle and defining an axis of rotation substantially parallel to the longitudinal axis of the handle. The power tool also includes a tool head selectively coupled to the handle, a first projection coupled to the handle and extending radially away from the longitudinal axis in a first direction, and a second projection coupled to the handle and extending radially away from the longitudinal axis in a second direction generally opposite the first direction. The first and second projections are moveable between first and second positions. In the first position, the projections are at a first radial distance from the longitudinal axis and are received within a portion of the tool head to couple the tool head to the handle. In the second position, the projections are at a second radial distance from the longitudinal axis that is less than the first radial distance and the projections are decoupled from the tool head. The first and second projections are biased to the first position.

In yet another aspect, the invention provides a power tool head removably connectable to a power tool handle, the power tool handle including an interface for being received by the power tool head, a motor, a drive shaft driven by the motor, a release member and a trigger lock button disposed in a raised boss. The power tool head includes an output for performing an operation on a work piece and a housing having an inner surface defining a main cavity for receiving the interface of the power tool handle, the housing having an outer surface generally opposite the inner surface. The power tool head also includes a first opening for selectively receiving the drive shaft for transferring rotation of the drive shaft to the output, the opening defining a central axis, and also includes a pin extending substantially parallel to the central axis for depressing the trigger lock button, and a second opening extending from the inner surface to the outer surface in a direction generally radial with respect to the central axis for receiving the release member.

In yet another aspect, the invention provides a power tool. The power tool includes a tool handle having a grip portion defining a longitudinal axis, a motor disposed within the handle and including a drive shaft having an axis of rotation substantially parallel to the longitudinal axis of the grip portion, a trigger positioned adjacent the grip portion for selectively activating the motor, and a handle interface. The power tool also includes a tool head for selectively coupling to the tool handle, the tool head having a head interface for coupling with the handle interface of the tool handle, a transmission driven by the drive shaft of the motor when the tool head is coupled to the tool handle, and an output member coupled to the transmission, the output member defining an axis generally perpendicular to the axis of rotation of the drive shaft.

In yet another aspect, the invention provides a power tool. The power tool includes a handle, a head selectively coupled to the handle, and a motor having a drive shaft extending therefrom, the drive shaft having a first central axis. The power tool also includes an opening for receiving the drive shaft of the motor for transferring rotation of the drive shaft to a tool output, the opening defining a second central axis. The power tool also includes a trigger for activating the motor, the trigger stop movable between a first position and a second position. In the first position the trigger stop engages the trigger in order to lock the trigger and prevent activation of the motor, and in the second position the trigger is unlocked to permit activation of the motor. The power tool also includes a linkage coupled to the trigger stop, the linkage being positioned at a first radial distance from the first central axis, and a plurality of actuators extending from the head and positioned at a second radial distance from the second central axis. The first radial distance is substantially equal to the second radial distance. When the head is coupled to the handle in a first rotational orientation, one of the plurality of actuators engages the linkage to move the trigger stop to the second position, and when the head is coupled to the handle in a second rotational orientation different from the first rotational orientation, another one of the plurality of actuators engages the linkage to move the trigger stop to the second position.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it should be understood that the phraseology and terminology used herein are for the purpose of description and should not be regarded as limiting.

DETAILED DESCRIPTION

FIGS. 1-5 illustrate a multi-function tool system according to one construction of the invention. The multi-function tool system includes a handle 100 (FIG. 1) and various attachment heads that attach to a common handle 100 and are driven by a motor 102 (FIG. 9) housed within the handle 100. In the illustrated construction, the motor 102 is 12V-DC, 2.0 Amps no load current. In other constructions, other suitable motors may be employed. In yet other constructions, a variable speed or multi-speed motor may be employed.

Figure 1:
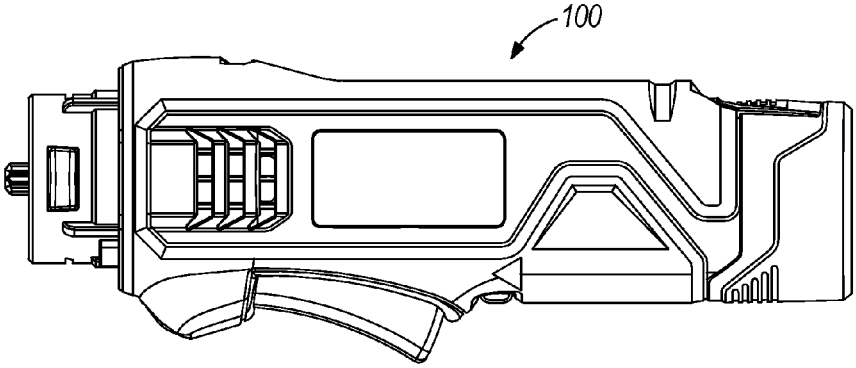
FIG. 1 is a side view of a tool handle according to one construction of the invention.
Figure 2:
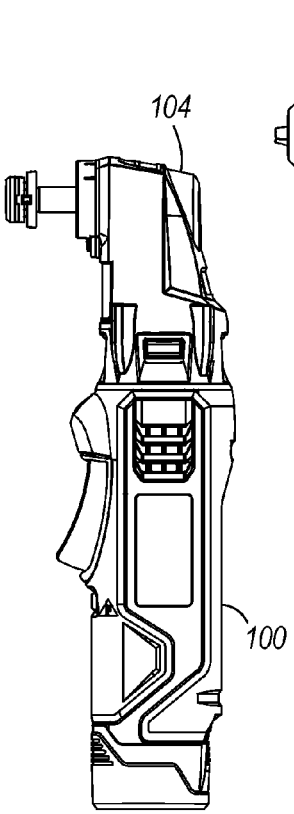
FIG. 2 is a side view of an oscillating tool head attached to the handle of FIG. 1.
Figure 3:
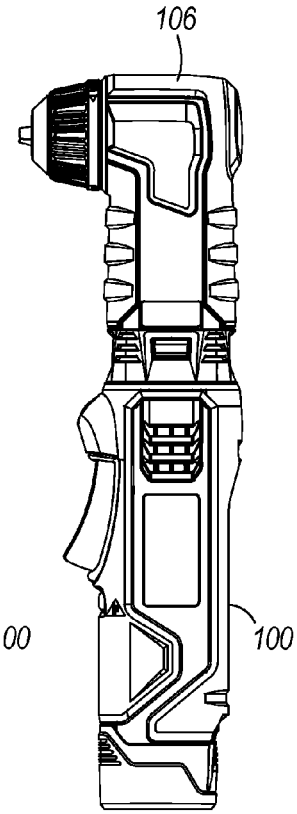
FIG. 3 is a side view of a drill attachment head attached to the handle of FIG. 1.
Figure 4:
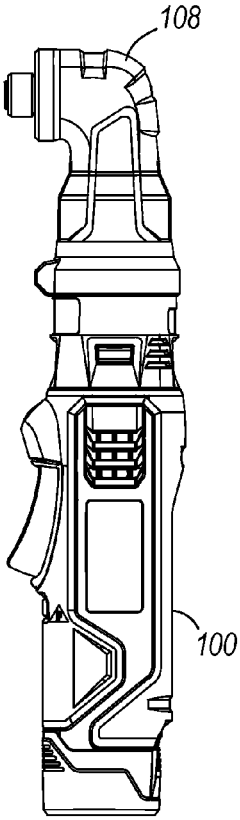
FIG. 4 is a side view of an impact driver attachment head attached to the handle of FIG. 1.
Figure 5:
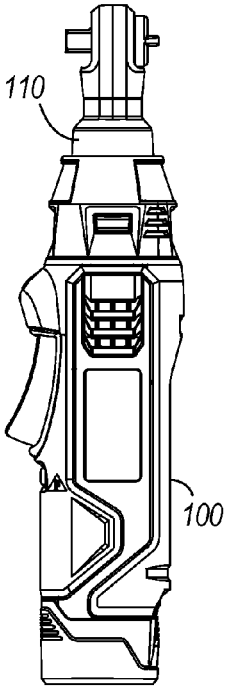
FIG. 5 is a side view of a ratchet wrench attachment head attached to the handle of FIG. 1.

FIG. 2 illustrates an oscillating attachment head 104 coupled with the handle 100 and driven by the motor 102. FIG. 3 illustrates a right angle drill attachment head 106 coupled with the handle 100 and driven by the motor 102. FIG. 4 illustrates a right angle impact driver attachment head 108 coupled with the handle 100 and driven by the motor 102. FIG. 5 illustrates a right angle ratchet wrench attachment head 110 coupled with the handle 100 and driven by the motor 102. In other constructions, other motor-driven attachment heads may be attached to the handle 100, and the attachments need not be right angle attachments.

Figure 6:
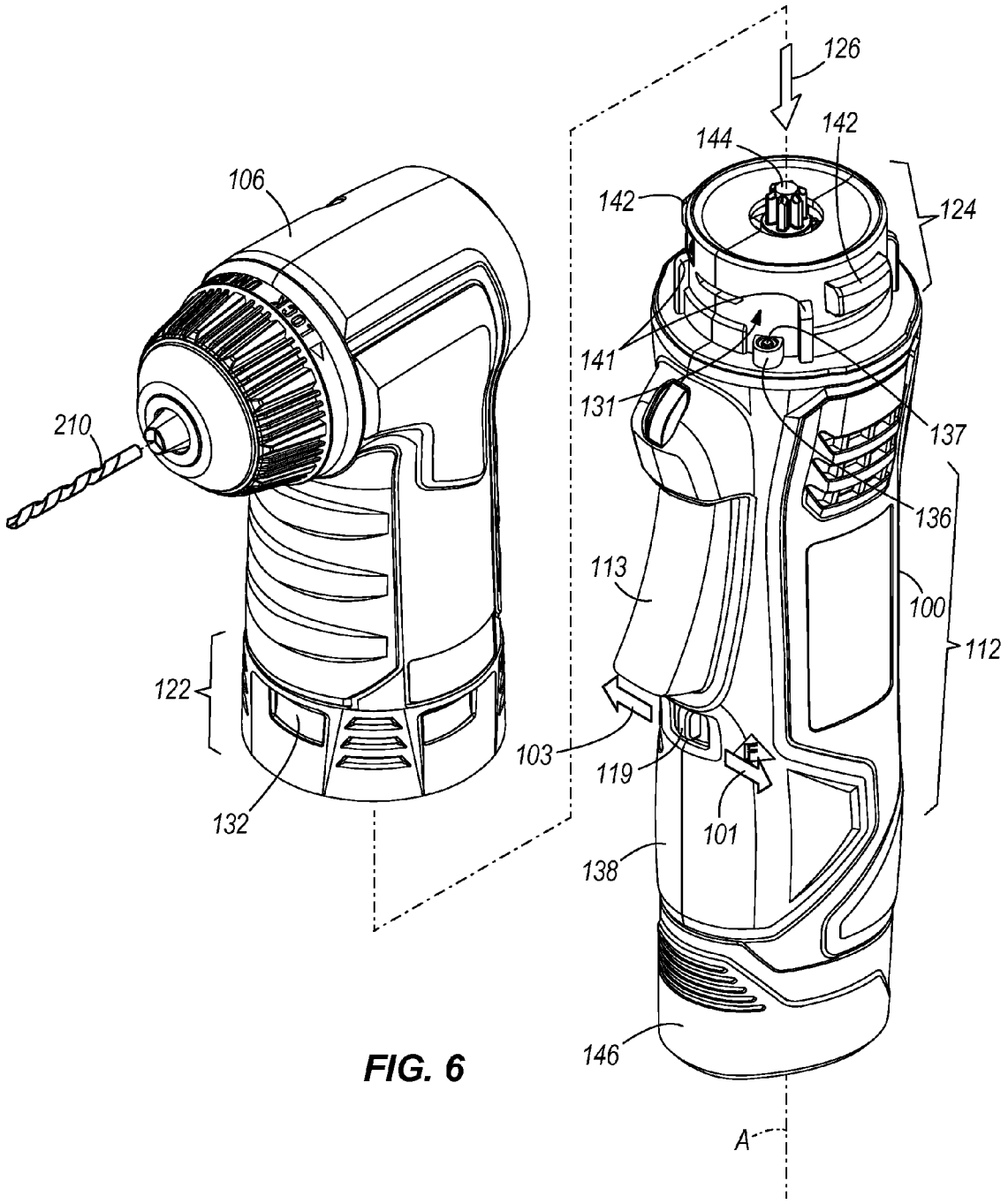
FIG. 6 is an exploded view of the drill attachment head and handle of FIG. 3.
Figure 7:
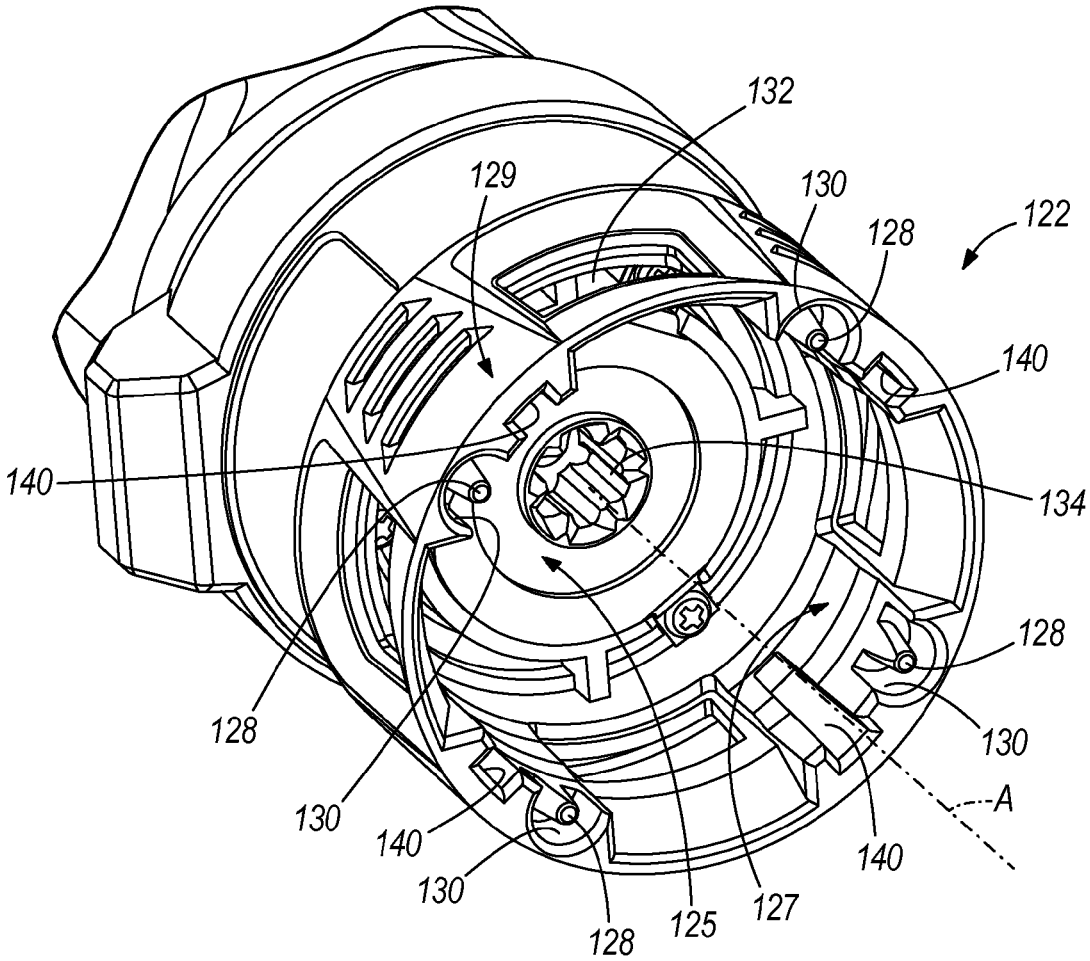
FIG. 7 is a detailed perspective view of a portion of an attachment head.

The multi-function tool system utilizes a single universal handle 100 for the various attachment heads 104-110. FIG. 6 illustrates the drill attachment head 106 and the handle 100 aligned along a longitudinal axis A for attachment between the drill attachment head 106 and the handle 100. The longitudinal axis A is defined by the handle 100 having a grip portion 112 and by the head 104-110, as will be described in greater detail below. The arrow 126 indicates the direction for attachment of the attachment head 106 to the handle 100, which is parallel to the longitudinal axis A. The other attachment heads 104, 108, 110 are similarly attached to the handle 100, and will be described in greater detail below. Referring to FIG. 7, each of the attachment heads 104-110 includes a housing having a common attachment head interface 122 for mating with a handle interface 124 of a housing 138 of the handle 100. The attachment head interface 122 includes pins 128, or actuators, extending parallel to the axis A and surrounded by semi-circular cavities 130 for receiving a boss 136 on the handle interface 124, which will be described in greater detail below. Four equally spaced pins 128 and cavities 130 are spaced radially about the axis A on an inner surface 127 of the attachment head interface 122, the inner surface 127 defining a main cavity 125 for receiving the handle interface 124. The pins 128 are positioned at a first radial distance from the axis A. In other constructions fewer or more pins and cavities may be employed. The attachment head interface 122 also includes axial grooves 140 for receiving ridges 141 on the handle interface 124, as will be described in greater detail below. Four equally spaced grooves 140 lie parallel to the axis A and are disposed on the inner surface 127 of the attachment head interface 122. In other constructions, fewer or more grooves may be employed.

The attachment head interface 122 also includes rectangular openings or recesses 132 positioned circumferentially about the attachment head 104-110 extending between the inner surface 127 and an outer surface 129 of the interface 122 for receiving radial projections 142 on the handle interface 124, which will be described in greater detail below. In the illustrated construction, four openings 132 are equally spaced from each other about the axis A; however, in other constructions, fewer or more openings may be employed and the openings may include other shapes. The attachment head interface 122 also includes a star-shaped central opening or central recess 134 centered about the axis A for receiving a motor drive shaft projection 144 of the handle interface 124, which will be described in greater detail below. In the illustrated construction, the central opening 134 is a six-point star shape with rounded tips; however, in other constructions, other numbers of points and other shapes may be employed.

FIG. 6 illustrates the handle interface 124. As the features of the head interface 122 are formed on the interior surface 127 of the head interface 122, the features of the handle interface 124 are formed on an exterior surface 131 of the handle interface 124. Thus, the exterior surface 131 of the handle interface 124 mates with the interior surface 127 of the head interface 122. The handle interface 124 includes a circular ring-shaped or U-shaped boss 136 extending from the outer surface 131 of the handle interface 124 parallel to the axis A for mating with one of the four pins 128 and semi-circular cavities 130 on the attachment head interface 122. In other constructions, more than one boss 136 may be employed.

The boss 136 includes a central opening in which a button 137, or linkage, is disposed, the central opening and button 137 extending in a direction substantially parallel to the longitudinal axis A. The button 137 is positioned at a second radial distance from the longitudinal axis A, which is substantially equal to the first radial distance of the pins 128. The button 137 is a safety device that prevents the motor 102 from being activated when there is no attachment head 104-110 attached to the handle 100. The button 137 is biased by a biasing member 139 (FIG. 9), such as a spring, to a locked position in which the button 137 is extended in the boss 136. In the locked position, a trigger stop 111 (FIG. 9) coupled to the button 137 prevents a trigger switch 113 from being moved to an actuated position, thus preventing the motor 102 from being activated. The button 137 is depressed and moved substantially parallel to the longitudinal axis A to an unlocked position when one of the pins 128 of the head interface 122 is received in the central opening of the boss 136. In the unlocked position, the button 137 is recessed in the boss 136. The pin 128 engages the button 137 to depress the button 137, which positions the switch trigger stop 111 to allow the trigger switch 113 to be actuated such that the motor 102 can be activated. The button 137 prevents the motor 102 from being operable when no attachment head 104-110 is attached to the handle 100. In other words, an attachment head must be attached to the handle 100 in order for the motor 102 to be operable.

The handle interface 124 also includes ridges 141 (FIG. 6) extending substantially parallel to axis A and projecting radially from the outer surface 131 of the handle interface 124. Four ridges 141 are employed in the illustrated construction and mate with the grooves 140 in the attachment head interface 122. In other constructions, fewer or more ridges and grooves may be employed. The handle interface 124 also includes rectangular radial projections 142 extending from the housing 138 radially away from the axis A. The projections 142 mate with the openings 132 in the attachment head interface 122. In the illustrated construction, two projections 142 are employed; however, in other constructions, fewer or more projections may be employed and the projections may have a shape other than rectangular. In the illustrated construction, there are four openings 132 and two projections 142. Preferably, the number of openings 132 is at least equal to the number of projections 142, although there may be more openings 132 to allow the head 104-110 to be attached to the handle 100 in various orientations, and the shape of the projections mate with the shape of the openings.

Figure 9:
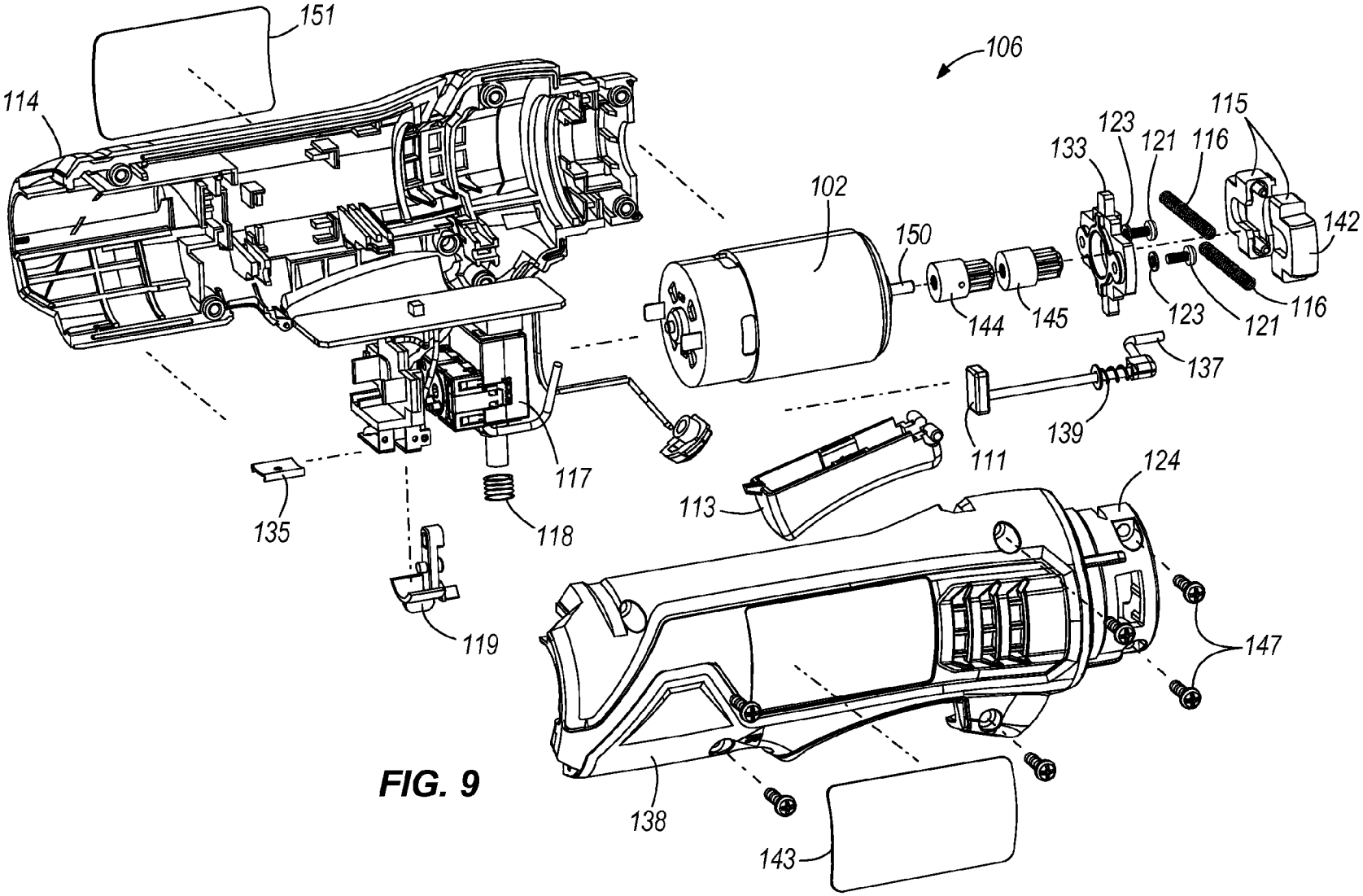
FIG. 9 is an exploded view of the handle of FIG. 1.

The handle interface 124 also includes a motor drive shaft projection 144 centered about the axis A and extending from a motor drive shaft 150 (FIG. 9). The motor drive shaft projection 144 is star-shaped and mates with the central opening 134 in the head interface 122. Therefore, both the motor drive shaft 150, motor drive shaft projection 144 and central opening 134 cooperate to define the longitudinal axis A, which is parallel and collinear when the head 104-110 is attached to the handle 100. A second motor drive shaft projection 145 (FIG. 9) may be employed to further extend the drive shaft 150 for connecting to some attachment heads. In the illustrated construction, a six-point star shape is employed. In other constructions, the motor drive shaft projection 144, 145 and central opening 134 may have other shapes suitable for transferring rotational motion from the motor drive shaft projection 144 to the attachment head 104-110.

Figure 8:
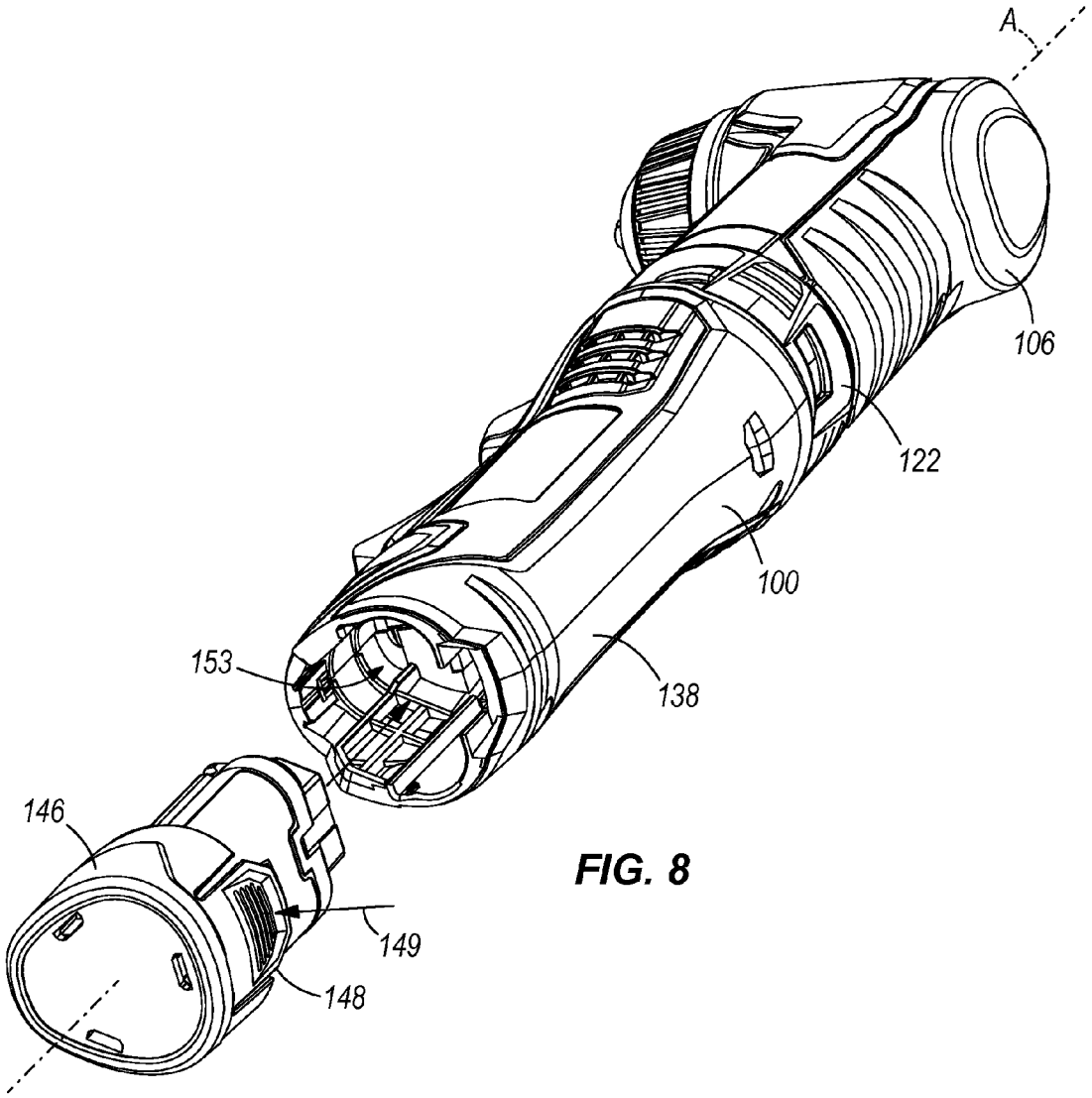
FIG. 8 is a perspective view of the drill attachment head and handle of FIG. 3 showing a battery exploded from the handle.

As illustrated in FIG. 8, the handle 100 includes a removable and rechargeable battery pack 146. In the illustrated embodiment, the battery pack 146 is a 12-volt battery pack and includes three (3) Lithium-ion battery cells. In other embodiments, the battery pack may include fewer or more battery cells such that the battery pack is a 14.4-volt battery pack, an 18-volt battery pack, or the like. Additionally or alternatively, the battery cells may have chemistries other than Lithium-ion such as, for example, Nickel Cadmium, Nickel Metal-Hydride, or the like.

The battery pack 146 is inserted into a cavity 153 (FIG. 8) in the handle housing 138 in the axial direction of axis A in order to snap into place. The battery pack 146 includes a latch 148, which can be depressed in the direction of arrow 149 to release the battery pack 146 from the handle 100. In the illustrated construction, the battery pack 146 has a capacity of 1.5 amp hours. In other constructions, other suitable batteries and battery packs may be employed. In yet other constructions, the tool handle 100 can include a cord and be powered by a remote source of power, such as a utility source connected to the cord.

FIG. 9 is an exploded view of the handle 100 according to one construction of the invention. The handle 100 includes the motor 102, the motor drive shaft 150 centered about the axis A, the motor drive shaft projection 144 coupled to the motor drive shaft 150, and a handle housing assembly 114 including the housing 138 and the handle interface 124. The radial projections 142 are formed separately from the housing 138 and project from button members 115, respectively, to form depressible release buttons. Button members 115 and projections 142 are disposed in the handle interface 124 and compression springs 116 are disposed between the button members 115, which bias the projections 142 outwardly from one another to a fully projected position at a first radial distance from the longitudinal axis A. The projections 142 are depressible inwards towards the longitudinal axis A at a second radial distance less than the first radial distance.

The handle 100 also includes a switch assembly 117, the switch trigger 113 and the switch trigger stop 111. The switch trigger 113 is coupled with the housing 138 and is depressible to actuate the switch assembly 117 when in a depressed position. The switch trigger 113 is biased to a non-depressed position by a spring 118. The switch assembly 117, when actuated, electrically couples the battery 146 and the motor 102 to run the motor 102. The switch trigger stop 111 is coupled to the button 137 disposed in the boss 136 and provides a barrier to prevent the switch trigger 113 from being movable to the actuated position (e.g., in which the motor 102 is supplied with power) when the button 137 is not depressed, as described above. When the button 137 is depressed, the switch trigger stop 111 moves to another position in which the switch trigger 113 may be depressed to the actuated position.

The handle 100 also includes a forward/reverse switch 119 (FIG. 6) having a first position, indicated by the arrow 101, for running the motor 102 in a first direction and a second position, indicated by the arrow 103, for running the motor 102 in a second direction opposite the first direction (e.g., forward and reverse). Other parts include screws 121 with spring washers 123, a motor mount 133, a housing connection knob 135, a data label 143, screws 147 for coupling the housing 138 together and a logo label 151.

Figure 10:
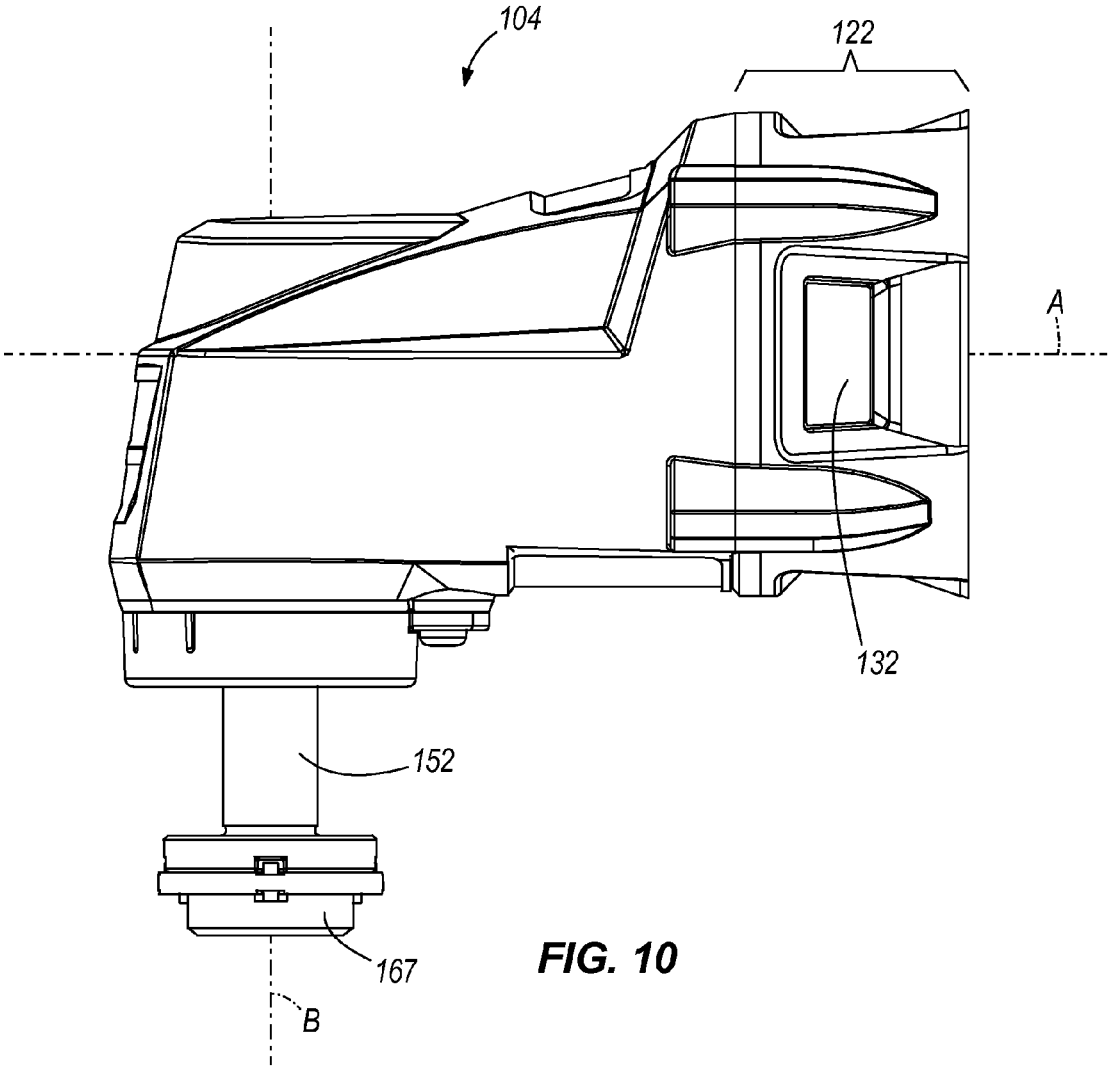
FIG. 10 is a side view of the oscillating tool head of FIG. 2.
Figure 11:
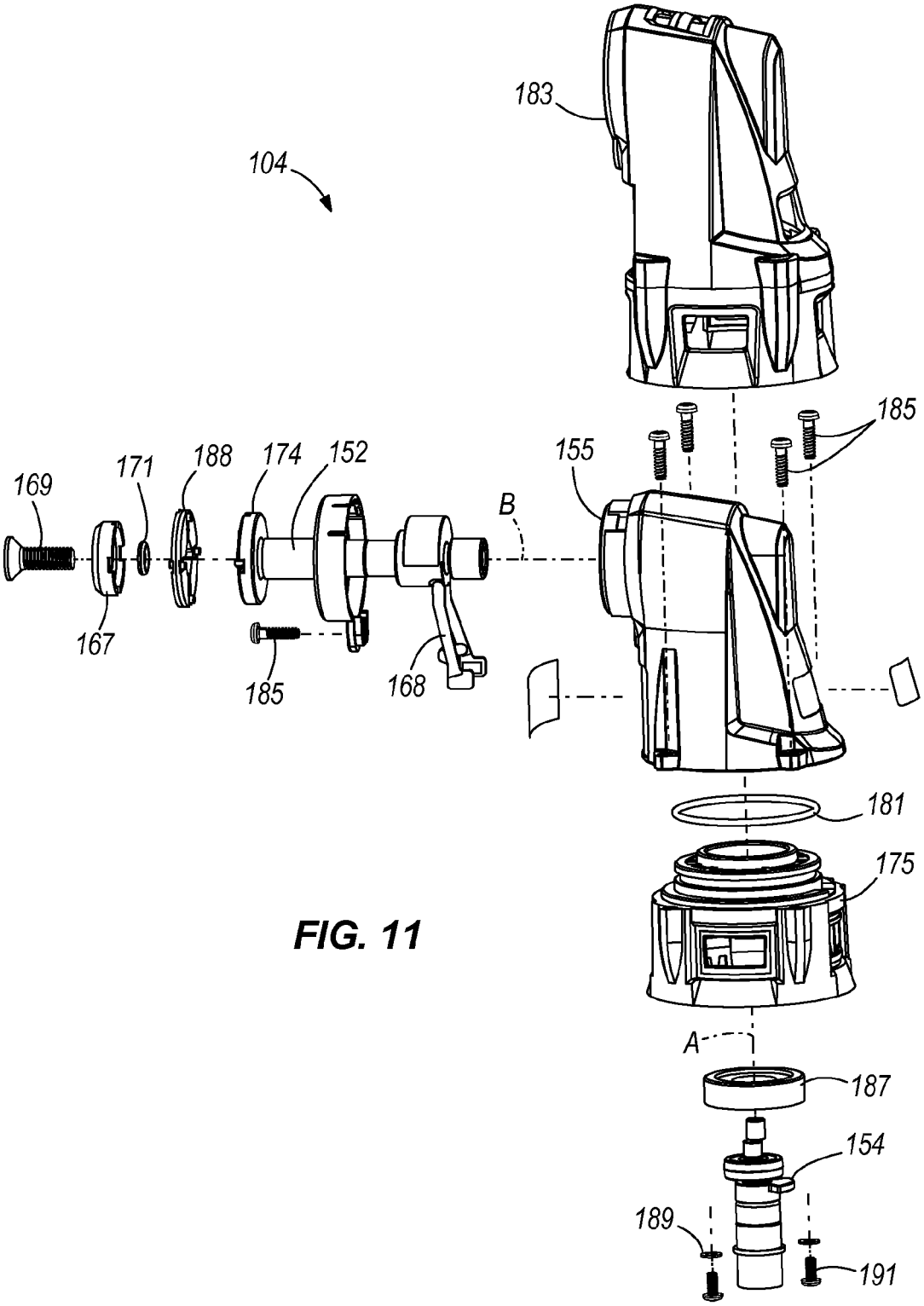
FIG. 11 is an exploded view of the oscillating tool head of FIG. 10.
Figure 12A:
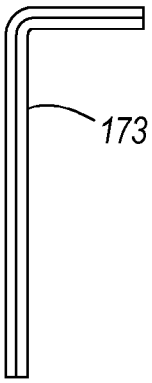
FIG. 12A is a side view of a hex key for use with the oscillating tool head of FIG. 10.
Figure 12B:
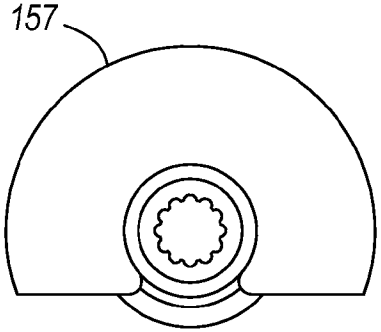
FIG. 12B is a bottom view of a flush cutting blade for use with the oscillating tool head of FIG. 10.
Figure 12C:
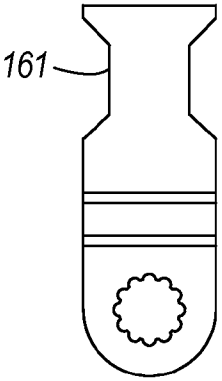
FIG. 12C is a bottom view of a wood/metal blade for use with the oscillating tool head of FIG. 10.
Figure 12D:
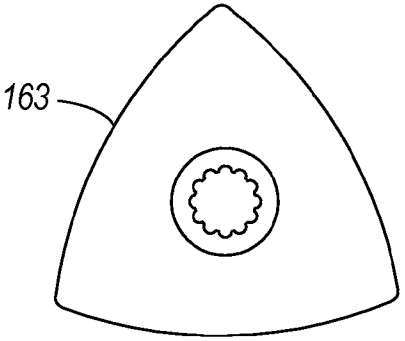
FIG. 12D is a bottom view of a sanding backing pad for use with the oscillating tool head of FIG. 10.
Figure 12E:
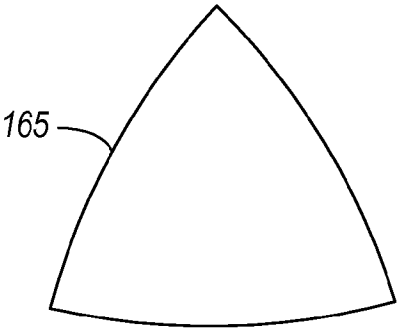
FIG. 12E is a bottom view of sandpaper for use with the sanding backing pad of FIG. 12D.
Figure 13:
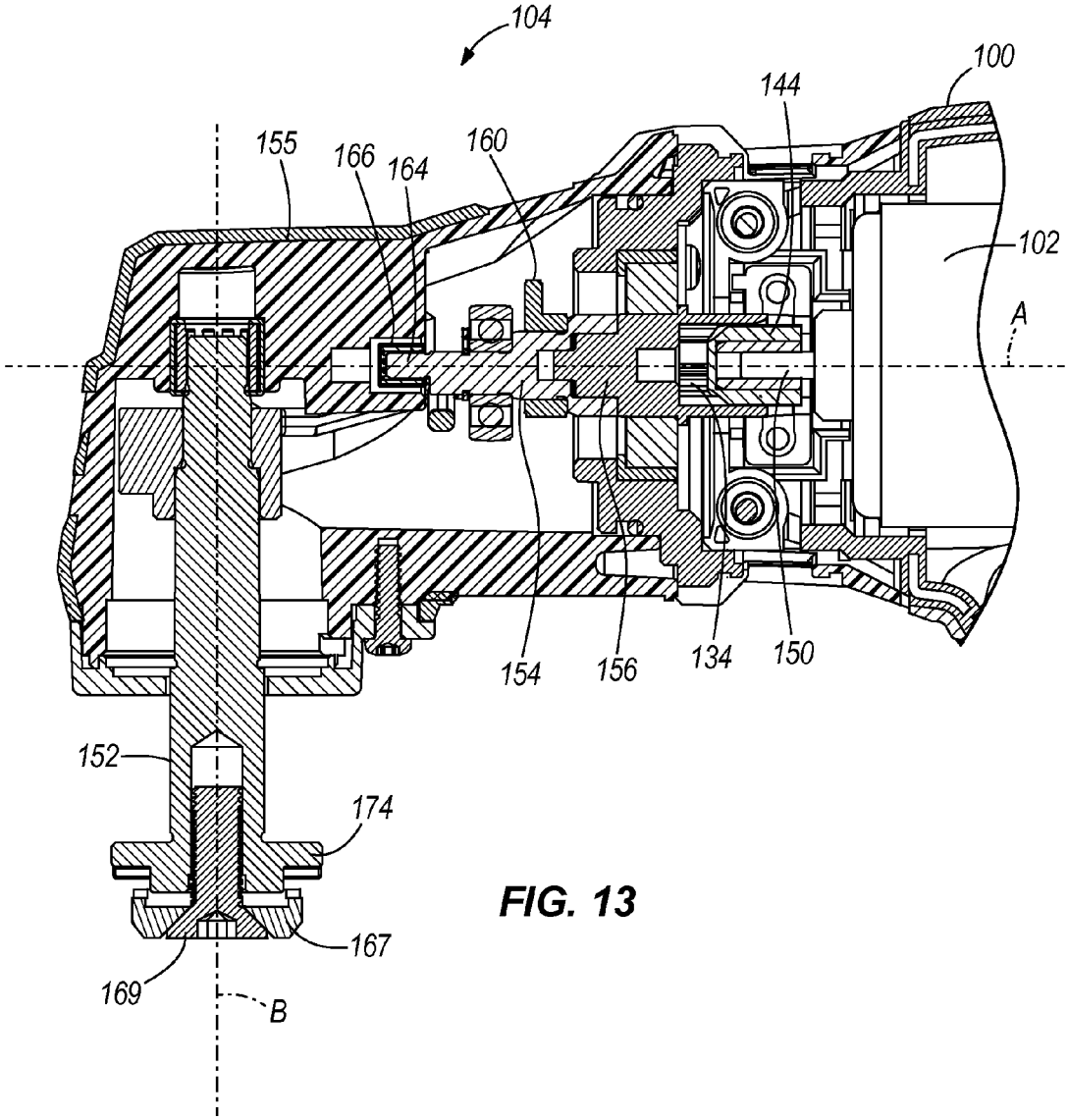
FIG. 13 is a cross section of the oscillating tool head of FIG. 10 taken in the same plane as FIG. 10.

FIG. 10 illustrates the oscillating attachment head 104 according to one construction of the invention. The oscillating attachment head 104 converts rotary motion of the motor drive shaft 150 into oscillating motion of a tool shaft 152. FIG. 11 is an exploded view of the oscillating attachment head 104, and FIGS. 12A-12E illustrate accessories for use with the oscillating attachment head 104. The tool shaft 152 defines a longitudinal axis B perpendicular to the axis A. FIG. 13 illustrates a cross section of the oscillating attachment head 104 attached to the handle 100. As shown in FIG. 13, the motor drive shaft projection 144 is coupled to an eccentric shaft 154 housed in the oscillating attachment head 104. The drive shaft projection 144 is received in the central opening 134, which is formed in a member 156. The eccentric shaft 154 is in turn coupled to the member 156 for rotation therewith.

Figure 14:
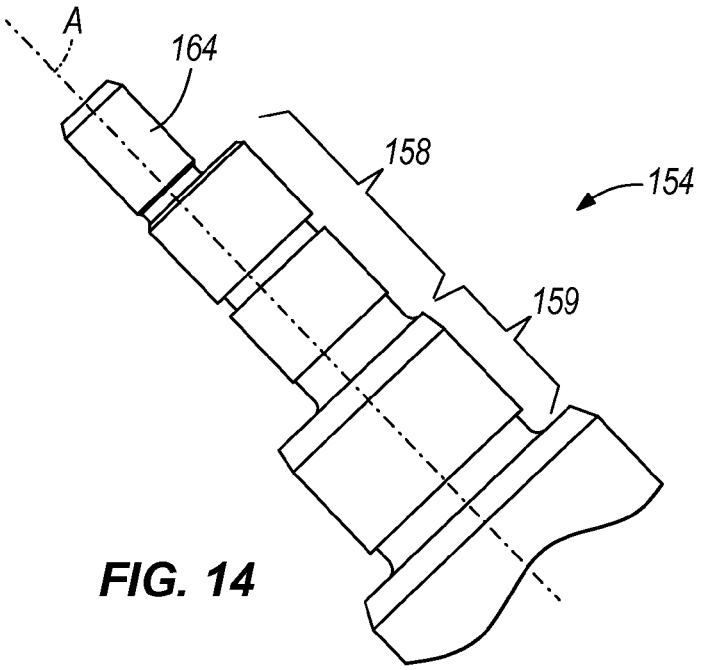
FIG. 14 is a side view of an eccentric member of the oscillating tool head of FIG. 13.
Figure 15:
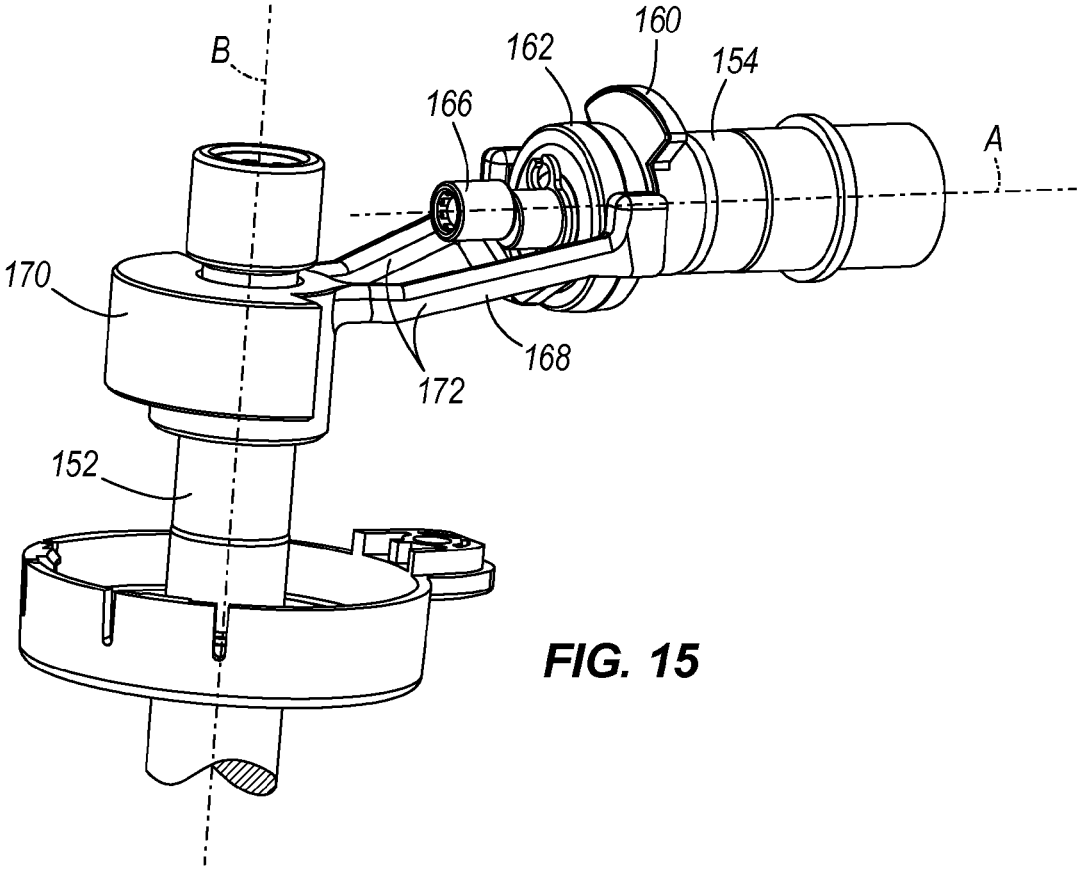
FIG. 15 is a perspective view of an oscillating drive of the oscillating tool head of FIG. 13.

The eccentric shaft 154 is illustrated separately in FIGS. 14 and 15, and includes an eccentric portion 158 that is not centered about the axis A. A counter balance 160 is press fit on a centered portion 159 of the eccentric shaft 154, and a ball bearing eccentric member 162 is press fit on the eccentric portion 158 of the eccentric shaft 154. The counter balance 160 counters the off-center rotation of the eccentric portion 158 and the ball bearing eccentric member 162 to reduce vibrations caused by the eccentric rotation thereof. The eccentric shaft 154 also includes a shaft extension 164 centered about the axis A. As shown in FIGS. 13 and 15, a bearing 166 is coupled to the outer circumference of the shaft extension 164. The bearing 166 is held in a housing 155 of the oscillating attachment head 104. The bearing 166 and shaft extension 164, with the support of the housing 155, constrain the eccentric shaft 154 to rotation about the axis A to reduce vibrations caused by rotation of the eccentric portion 158.

A forked member 168 is coupled to the oscillating tool shaft 152 by a sleeve 170 and includes two prongs 172. The prongs 172 are positioned adjacent opposite sides of the ball bearing eccentric member 162 and transfer eccentric rotary motion of the ball bearing eccentric member 162 into oscillating motion of the oscillating tool shaft 152 about the axis B.

Figure 16:
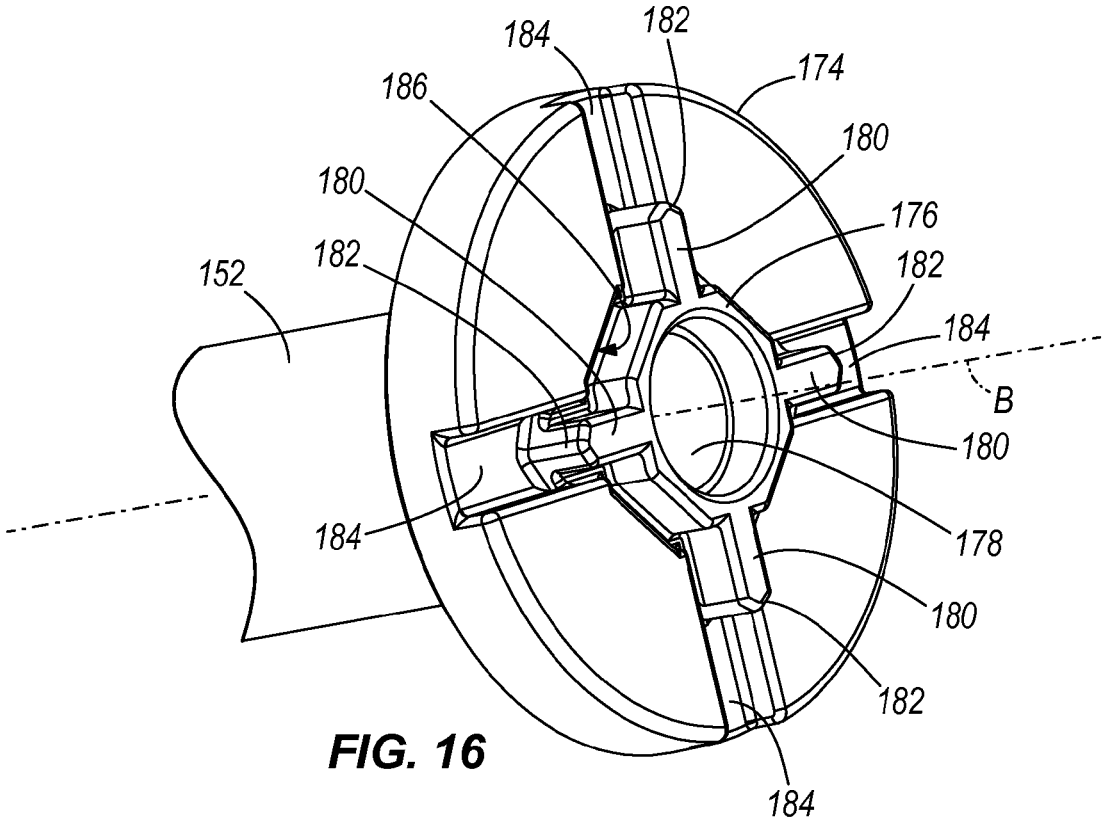
FIG. 16 is a perspective view of an arbor of the oscillating tool head of FIG. 10.
Figure 17:
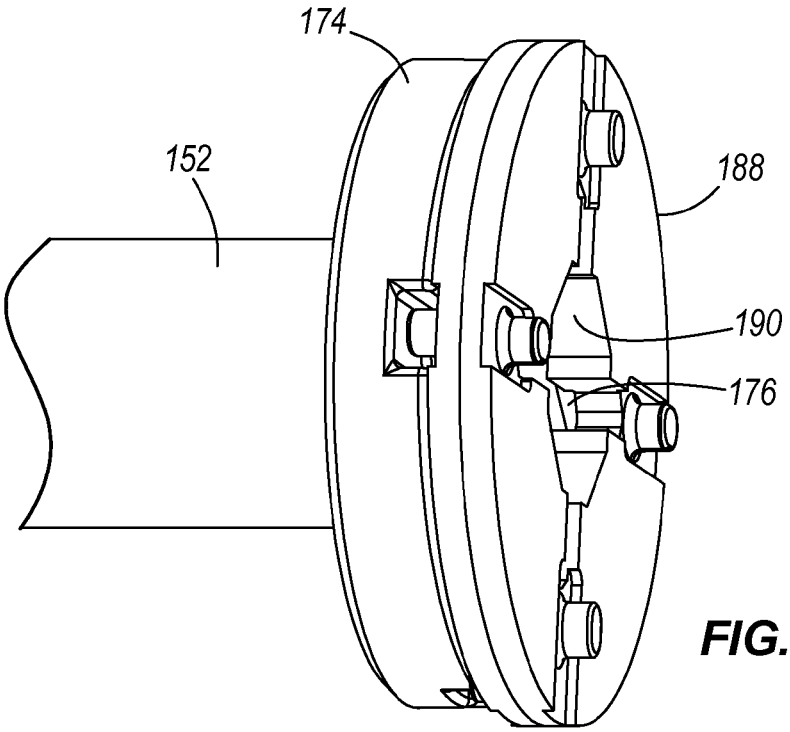
FIG. 17 is a perspective view of an adapter attached to the arbor of FIG. 16.
Figure 18:
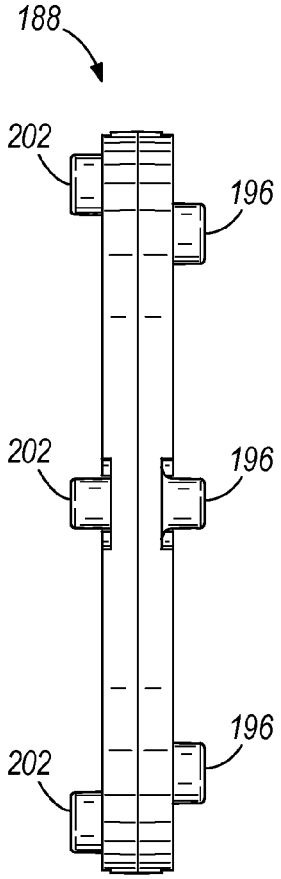
FIG. 18 is a side view of the adapter of FIG. 17.
Figure 19A:
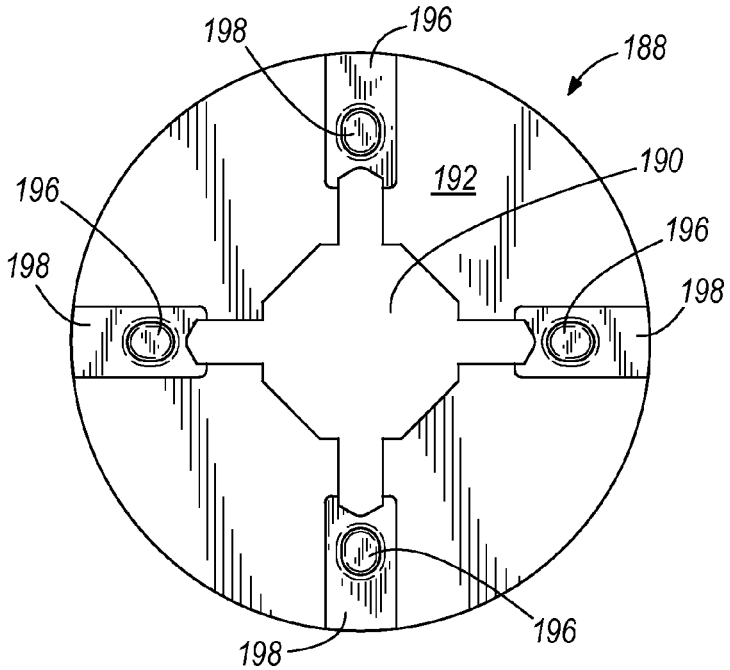
FIG. 19A is a front view of the adapter of FIG. 18.
Figure 19B:
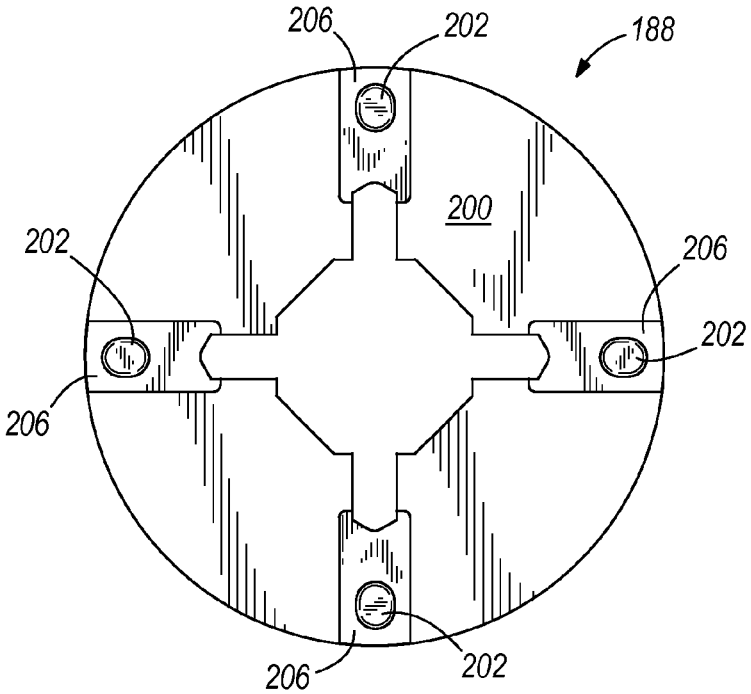
FIG. 19B is a rear view of the adapter of FIG. 18.

As shown in FIG. 16, the oscillating tool shaft 152 terminates, at a free end, with an arbor 174. In the illustrated construction, the arbor 174 is unitarily formed with the oscillating tool shaft 152; however, in other constructions, the arbor 174 may be a separate piece coupled with the oscillating tool shaft 152. The arbor 174 includes a central locating portion having a raised locating feature 176. The raised locating feature 176 has an octagon shape with a central, circular aperture 178 therethrough and four arms 180 extending radially therefrom. In the illustrated construction, each of the arms 180 extends from a side of the locating feature 176. Each of the arms 180 is angularly spaced about 90 degrees apart from the adjacent arms 180 and includes a generally pointed tip 182 having a small round. The arbor 174 also includes four grooves 184 extending radially from the octagonal raised locating feature 176, and shallower grooves 186 connecting the four radial grooves 184 around a periphery of the raised locating feature 176. Each of the four arms 180 is raised out of one of the four radial grooves 184 and extends parallel thereto.

As shown in FIGS. 17-20, the oscillating attachment head 104 also includes a two-sided adapter 188 for mating with the arbor 174 and modifying the raised locating feature 176 in two configurations. The adapter 188 includes an opening 190 shaped to receive the raised locating feature 176 of the arbor 174. Specifically, the opening 190 is shaped as an octagon having four arms extending radially therefrom. Each of the arms is angularly spaced about 90 degrees apart from the adjacent arms and includes a generally pointed tip with a small round. A first side 192 (FIG. 19A) of the adapter 188 provides a first modified raised locating feature including a first set of four raised elliptical or oval-shaped projections 196 angularly spaced approximately 90 degrees apart, each of the projections 196 located proximate one of the arms of the opening 190 at a first radial distance. The first set of raised projections 196 is raised from four channels 198 extending radially from each of the four arms of the opening 190 on the first side 192. A second side 200 (FIG. 19B) of the adapter 188 provides a second modified raised locating feature including a second set of four raised elliptical or oval-shaped projections 202 angularly spaced approximately 90 degrees apart, each of the projections 202 located proximate one of the arms of the opening 190 at a second radial distance different from the first radial distance, the second distance being greater than the first distance in the illustrated construction. The second set of raised projections 202 is raised from four channels 206 extending radially from each of the four arms of the opening 190 on the second side.

Figure 20:
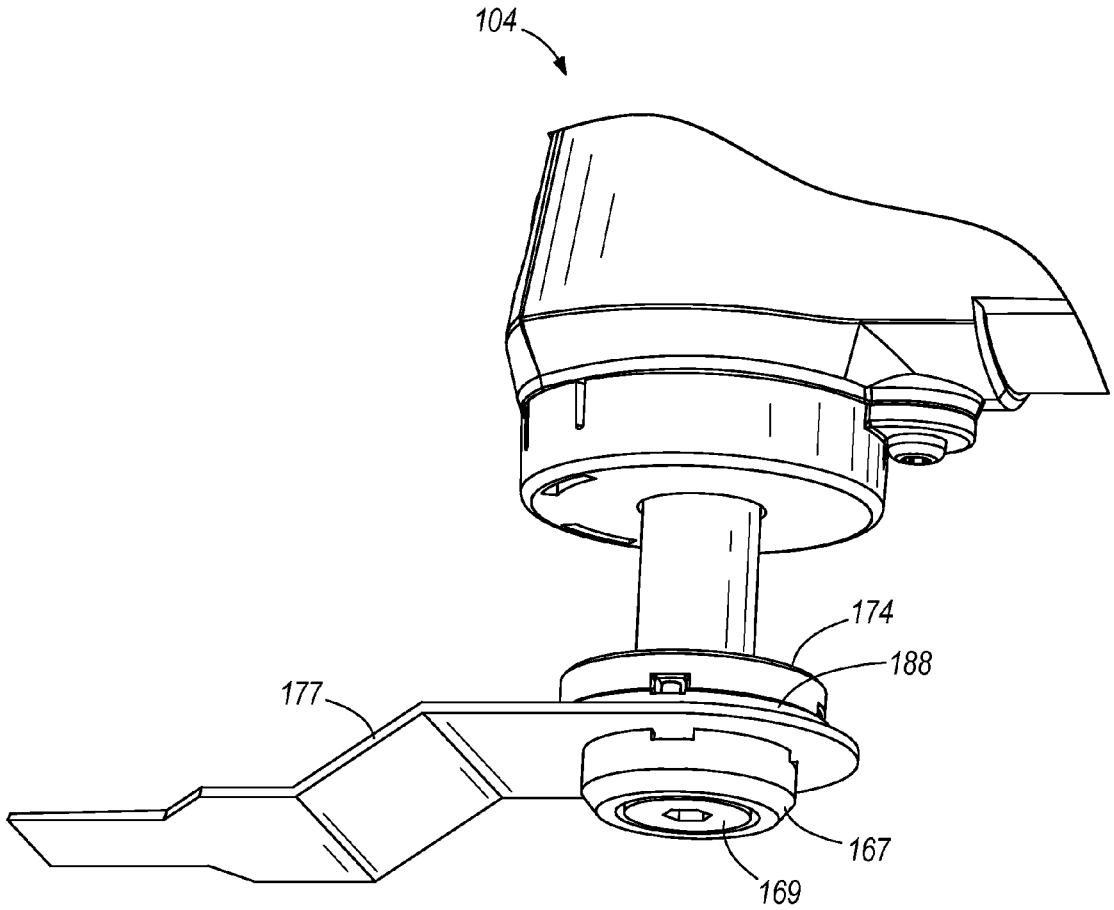
FIG. 20 is a partial perspective view of the oscillating tool head of FIG. 10 having a blade attached thereto.

In one use of the arbor 174, a tool or blade having a twelve-point star opening is provided for mating with the arbor 174, although other tools may also be utilized. Examples of tools 157, 161, 163 attachable to the arbor 174 are shown in FIG. 12B-12D. A twelve-point star tool is illustrated in expired U.S. Pat. No. 4,989,320 and includes an opening having substantially linear star-shaped edges. A sanding pad tool attachment 163 also has the twelve-point star opening and may be used with various types of sandpaper 165 (FIG. 12E), such as 60 grit, 80 grit and 120 grit sandpaper, amongst others. The adapter 188 is used to mate with other tools or blades having differently-shaped openings. Referring to FIG. 20, a blade 177 is secured between a sleeve 167 and the arbor 174, or between the sleeve 167 and the adapter 188, if the adapter 188 is necessary. In the illustrated construction, the adapter 188 is used to secure the blade 177. A screw 169 and O-ring 171 (FIG. 11) fasten the sleeve 167, blade 177, and, if necessary, the adapter 188, to the arbor 174 through the openings 190 and 178. A hex key 173 (FIG. 12A) is used to engage the screw 169 to tighten and loosen the screw 169.

As illustrated in FIG. 11, the oscillating attachment head 104 also includes a rear head housing 175, or head interface 122, coupled to the housing 155 and having an O-ring 181 therebetween. A rubber boot 183 covers the housing 155 and rear head housing 175 in the final assembly of the oscillating attachment head 104. The rubber boot 183 covers an outer surface of the head interface 122. The head 104 also includes screws 185, a rubber bearing seat 187, washers 189 and screws 191.

Figure 21:
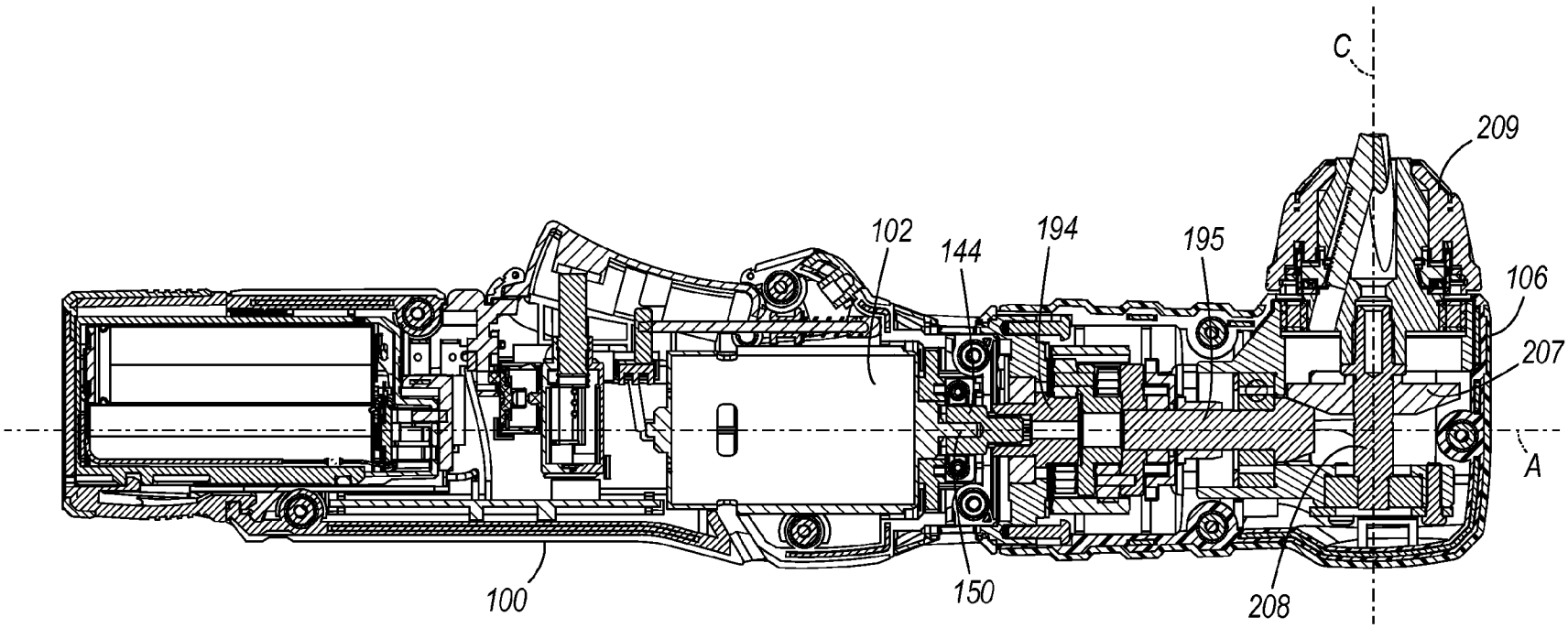
FIG. 21 is a cross section of the drill attachment head and handle of FIG. 3 taken in the plane of FIG. 3.
Figure 22:
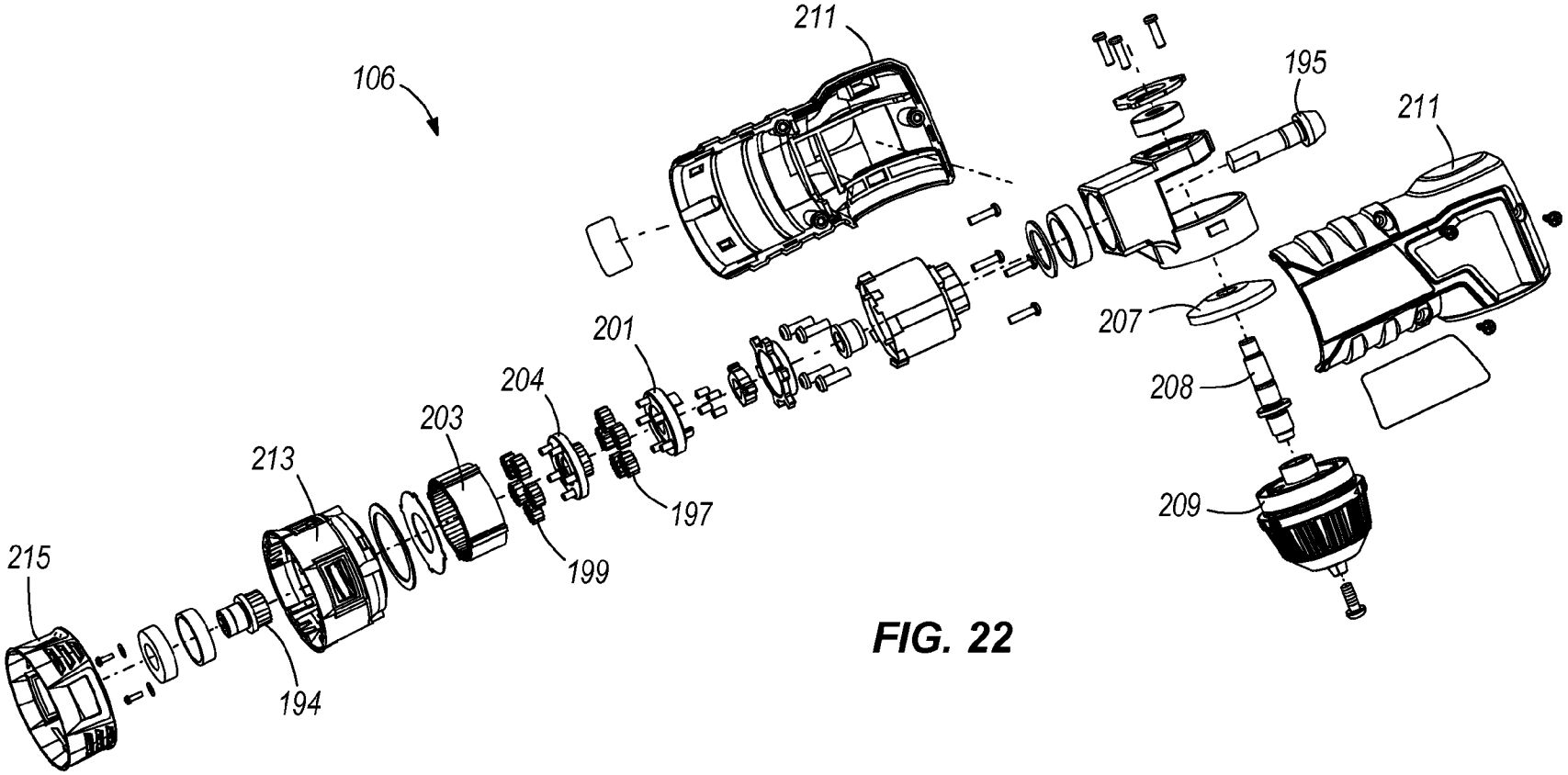
FIG. 22 is an exploded view of the drill attachment head of FIG. 3.

FIGS. 3 and 21-22 illustrate the drill head attachment 106 according to one construction of the invention. The drill attachment head 106 is a compact, right angled tool for manipulation in small spaces. FIG. 21 shows a cross-section of the drill head attachment 106 coupled to the handle 100. FIG. 22 illustrates an exploded view of the drill head attachment 106. The drill head attachment 106 includes a sun gear 194 coupled with the motor drive shaft projection 144 for rotation therewith. A bevel pinion 195 is centered about the axis A and receives rotational motion from the sun gear 194 by way of planetary gears 197, 199, carrier 201, ring gear 203 and sun gear 204, amongst other associated parts, in a manner well understood in the art. The bevel pinion 195 mates with a bevel gear 207 to transfer rotational movement of the bevel pinion 195 to rotational movement of an output shaft 208. The output shaft 208 defines a longitudinal output axis C perpendicular to the axis A and is coupled to a chuck assembly 209 for receiving and grasping a bit 210 (FIG. 6). The total gear ratio of the illustrated drill head attachment 106 is about 36.38. In other constructions, the drill head attachment 106 may have other desired gear ratios.

As illustrated in FIG. 22, the drill head attachment 106 is housed within a housing cover assembly 211, which is coupled to a gear housing 213 having a rubber boot 215 therearound. The gear housing 213 and rubber boot 215 form the head interface 122 for the drill head attachment head 106. The chuck assembly 209 is coupled to the housing cover assembly 211. The drill head attachment head 106 also includes various washers, fasteners, rings, bearings and the like, which are shown in FIG. 22.

Figure 23:
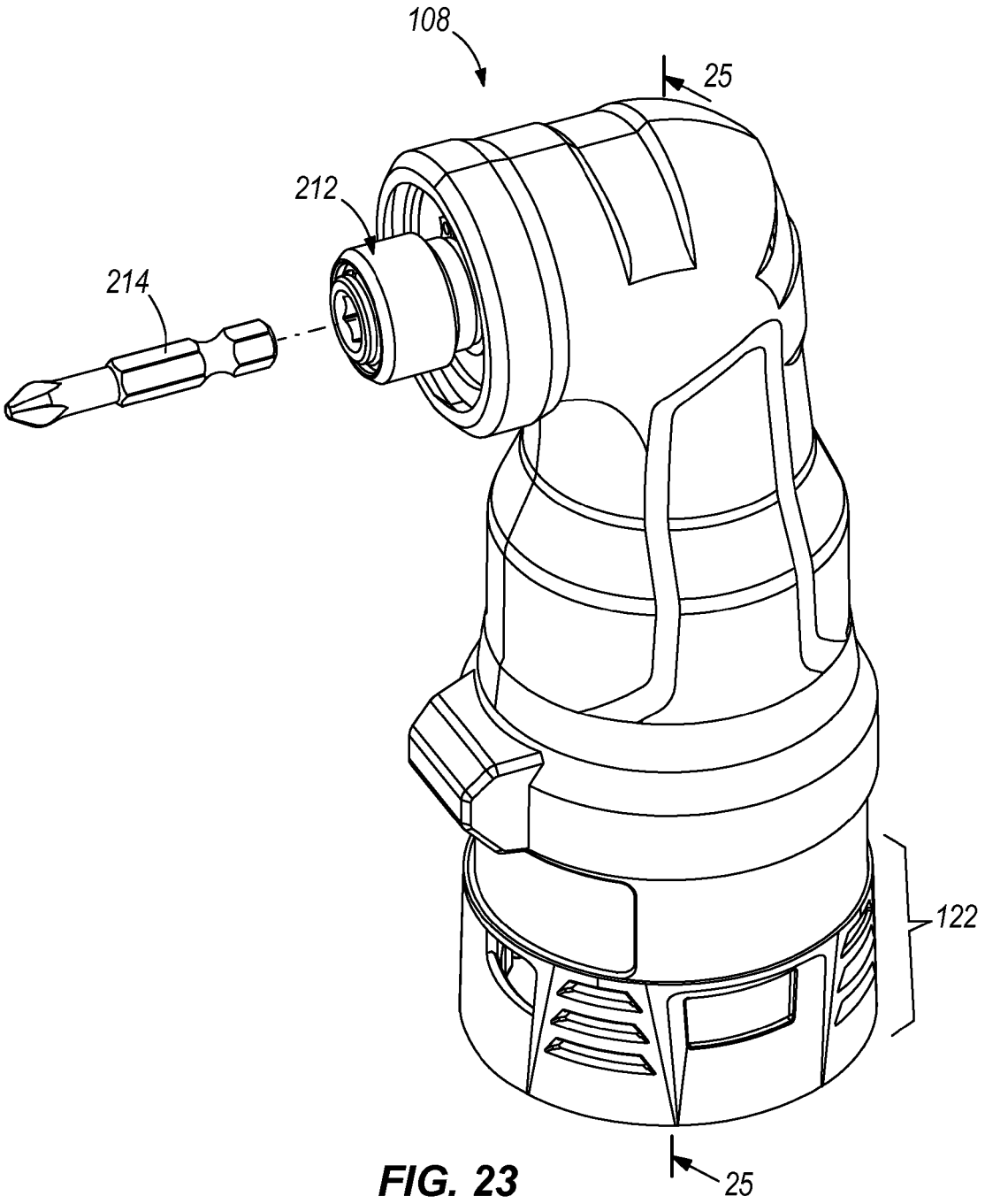
FIG. 23 is a perspective view of the impact driver attachment head of FIG. 4 having a bit.
Figure 24:
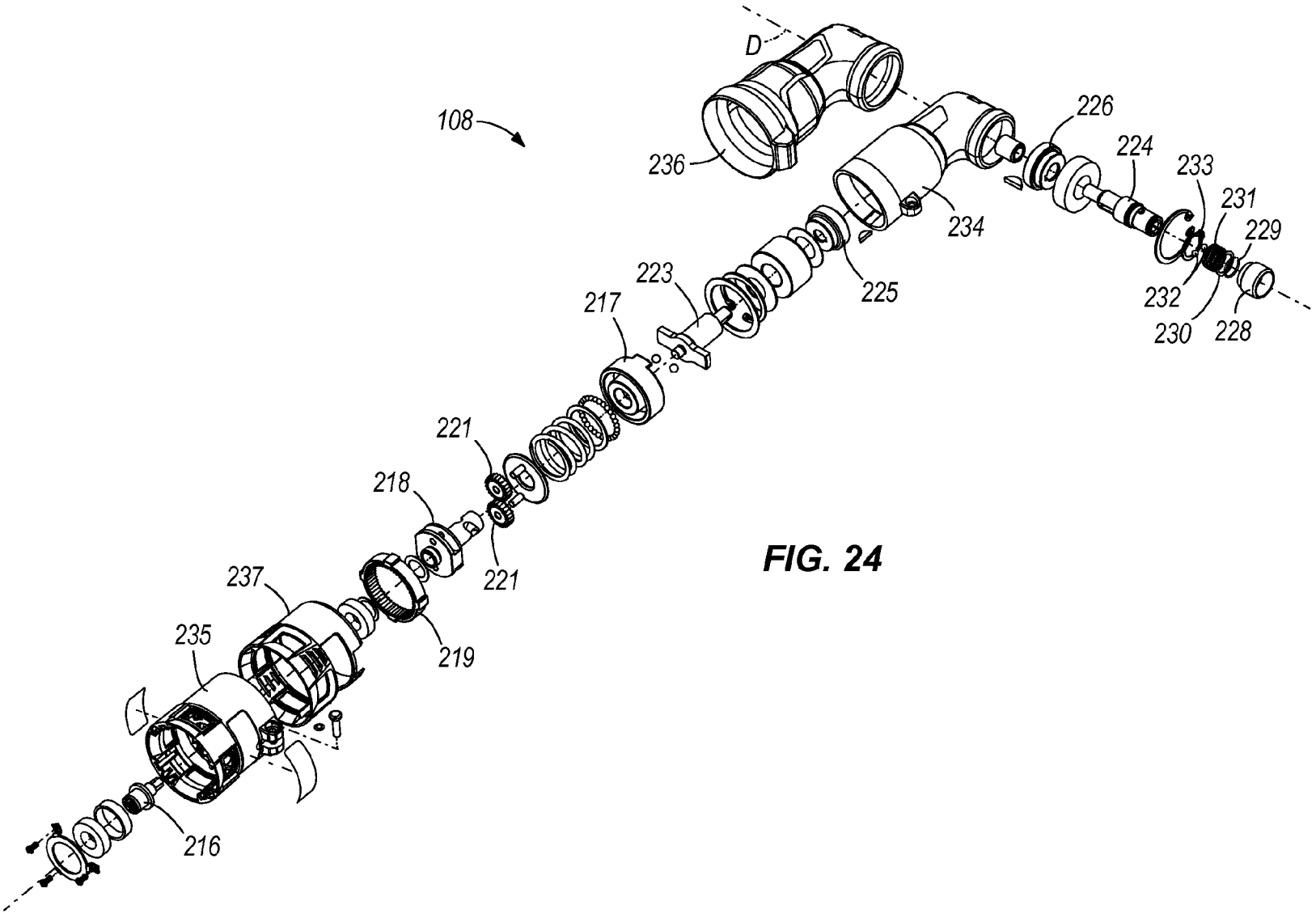
FIG. 24 is an exploded view of the impact driver attachment head of FIG. 23.
Figure 25:
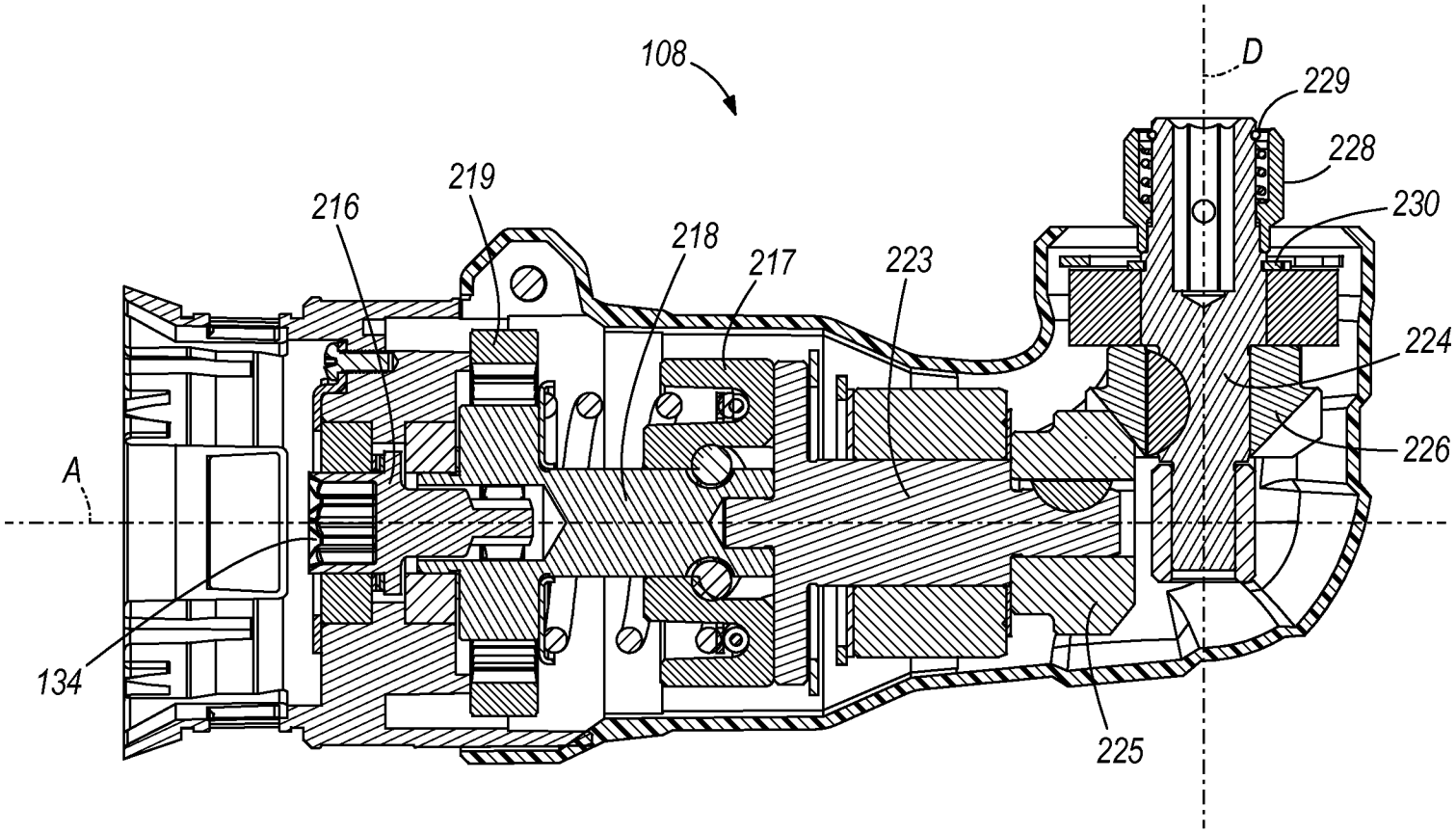
FIG. 25 is a cross section of the impact driver attachment head taken along line 25-25 in FIG. 23.

FIGS. 23-25 illustrate the impact driver attachment head 108 according to one construction of the invention. The impact driver head 108 is a compact, right angled tool for manipulation in small spaces. The impact driver attachment head 108 includes a coupler 212 that receives a bit 214. An exploded view of the impact driver attachment head 108 is shown in FIG. 24.

FIG. 25 is a cross section of the impact driver attachment head 108. The impact driver attachment head 108 includes a motor pinion 216 that includes the central opening 134 for receiving the motor drive shaft projection 144 or 145 and transfers rotational motion of the motor 102 to a hammer 217 with the cooperation of a cam shaft 218, a ring gear 219 and planetary gears 221 (FIG. 24). The hammer 217 rotates freely and then impacts an anvil 223 to provide a high torque impact, which is transferred to an output shaft 224 by way of a spiral bevel pinion 225 and spiral bevel gear 226. The output shaft 224 is coupled to a sleeve 228 by way of a retainer ring 229, an upper spring washer 230, a spring sleeve 231, balls 232 and a C-ring 233. Together, the output shaft 224 and sleeve 228 form the coupler 212. The output shaft 224 defines a longitudinal output axis D oriented perpendicular to the axis A. The total gear ratio of the impact driver attachment head 108 is about 9.33. In other constructions, the impact driver attachment head 108 may have other desirable gear ratios.

As shown in FIG. 24, the impact driver attachment head 108 is housed within a gear case 234 and a rear gear housing 235. The gear case is covered by a rubber boot 236 and is coupled to the rear gear housing 235, which is covered with a rear rubber boot 237. The rear gear housing 235 forms the head interface 122 for the impact driver attachment head 108. The impact driver attachment head 108 also includes various washers, fasteners, rings, bearings and the like, which are shown in FIG. 24.

Figure 26B:
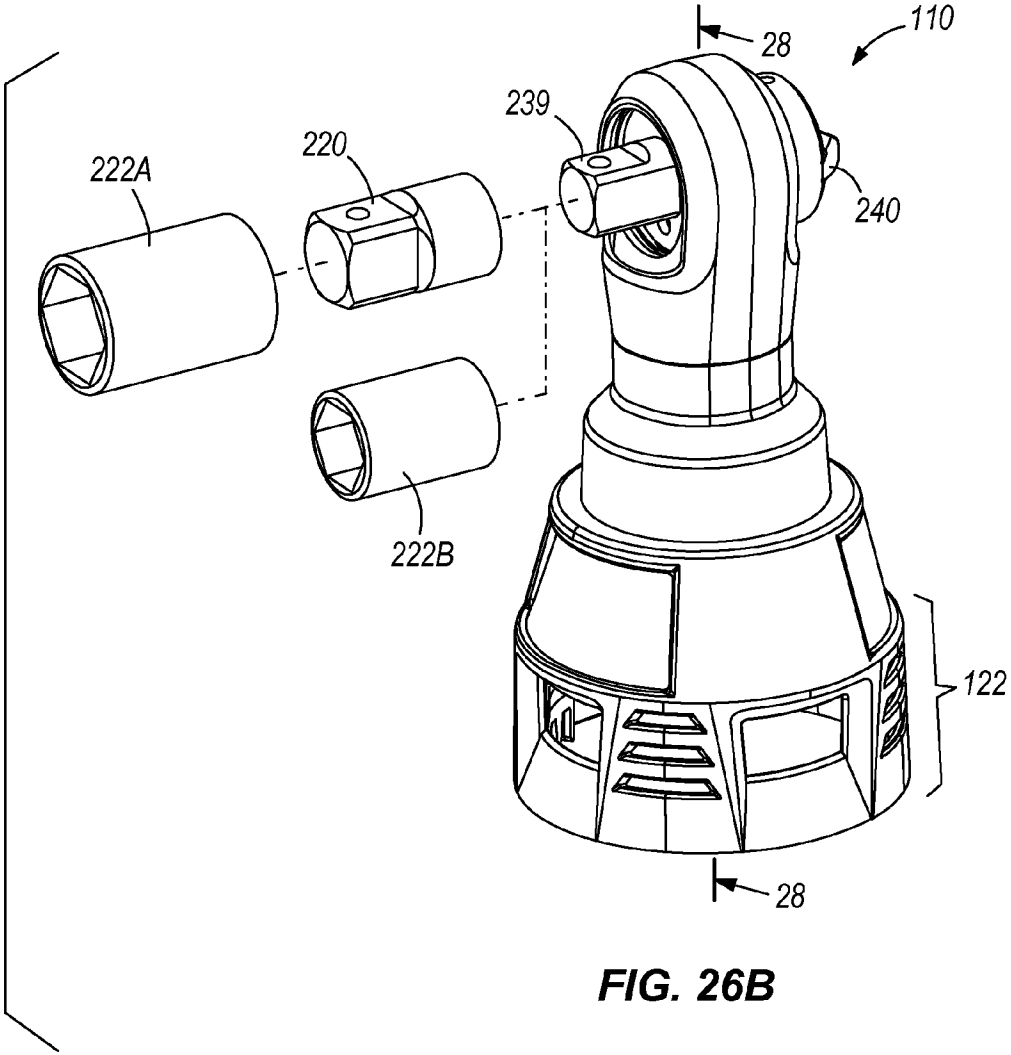
FIG. 26B is a front perspective view of the ratchet wrench attachment head of FIG. 5 including an adapter and sockets.
Figure 26A:
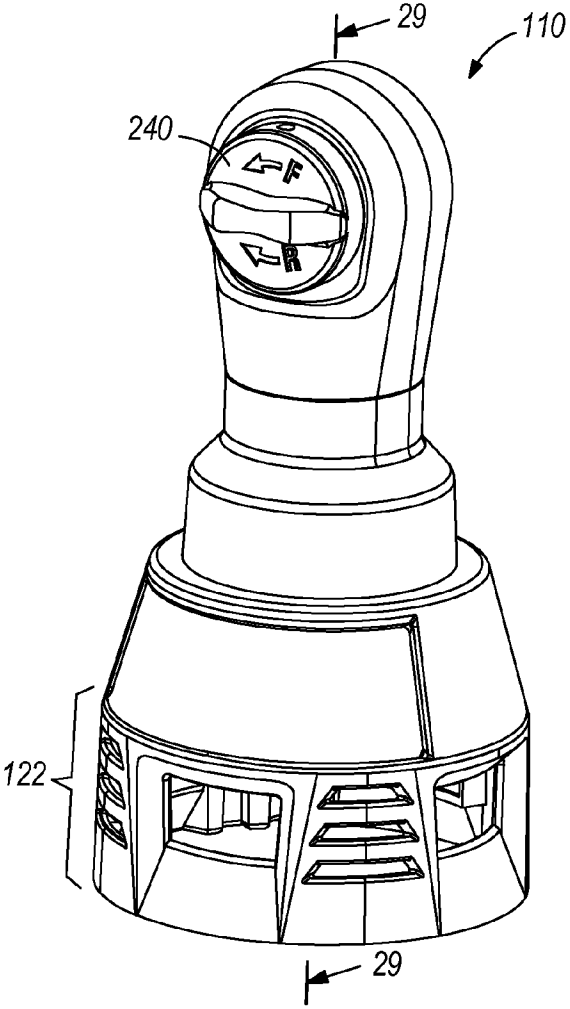
FIG. 26A is a rear perspective view of the ratchet wrench attachment head of FIG. 5.
Figure 27:
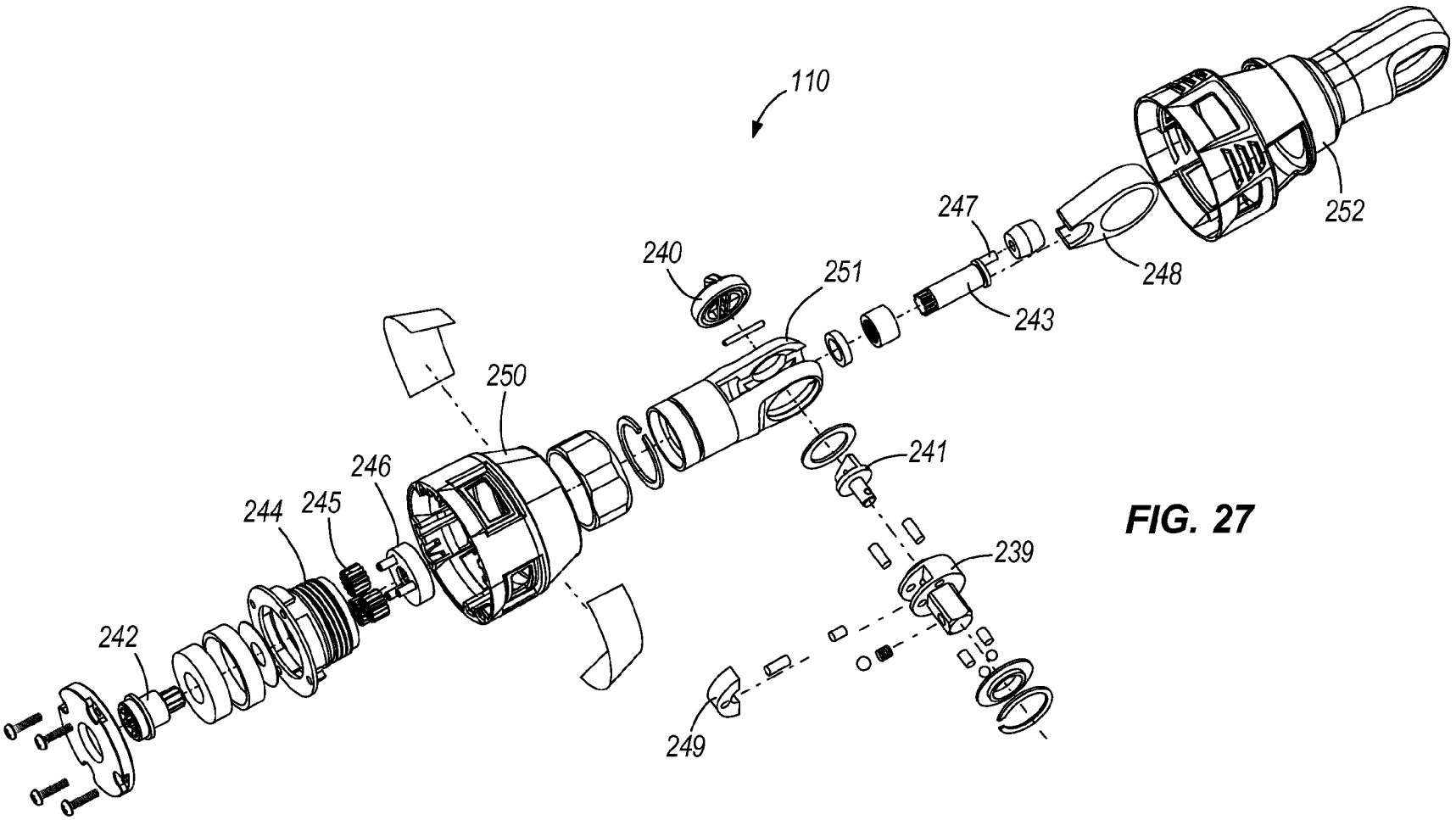
FIG. 27 is an exploded view of the ratchet wrench attachment head of FIG. 26A.
Figure 28:
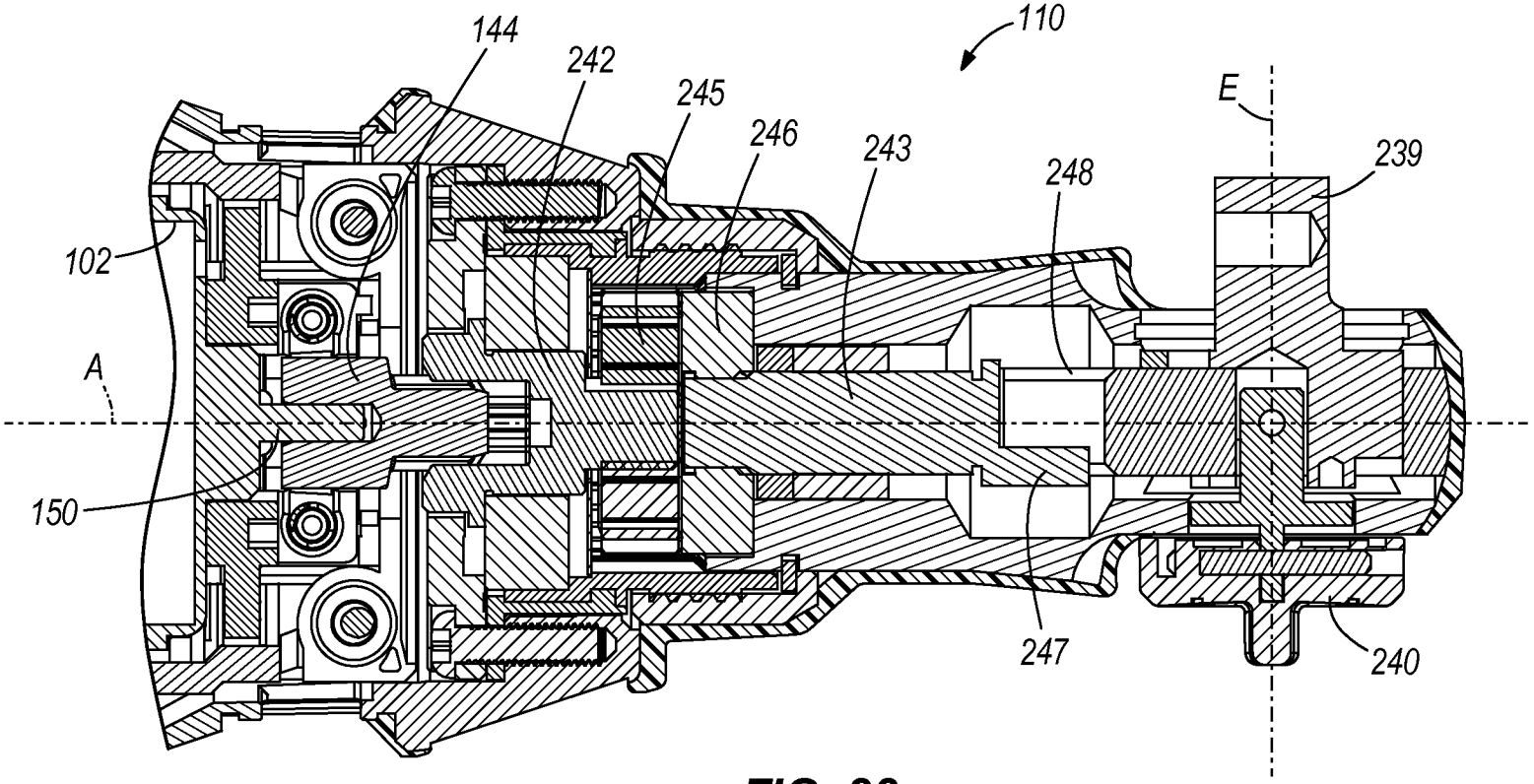
FIG. 28 is a cross section of the ratchet wrench attachment head taken along line 28-28 of FIG. 26B.
Figure 29:
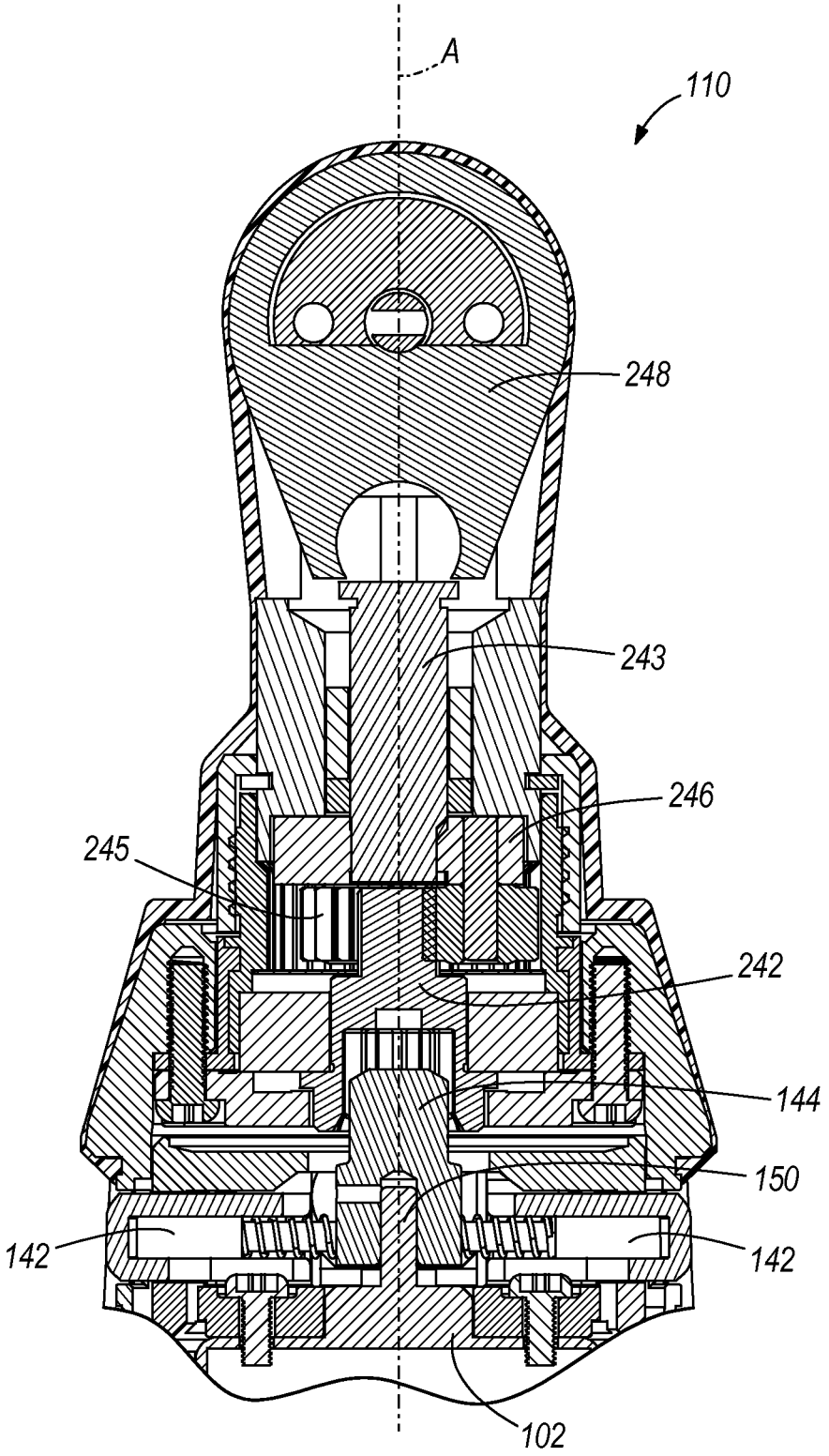
FIG. 29 is a cross section of the ratchet wrench attachment head taken along line 29-29 of FIG. 26A.
Figure 30:
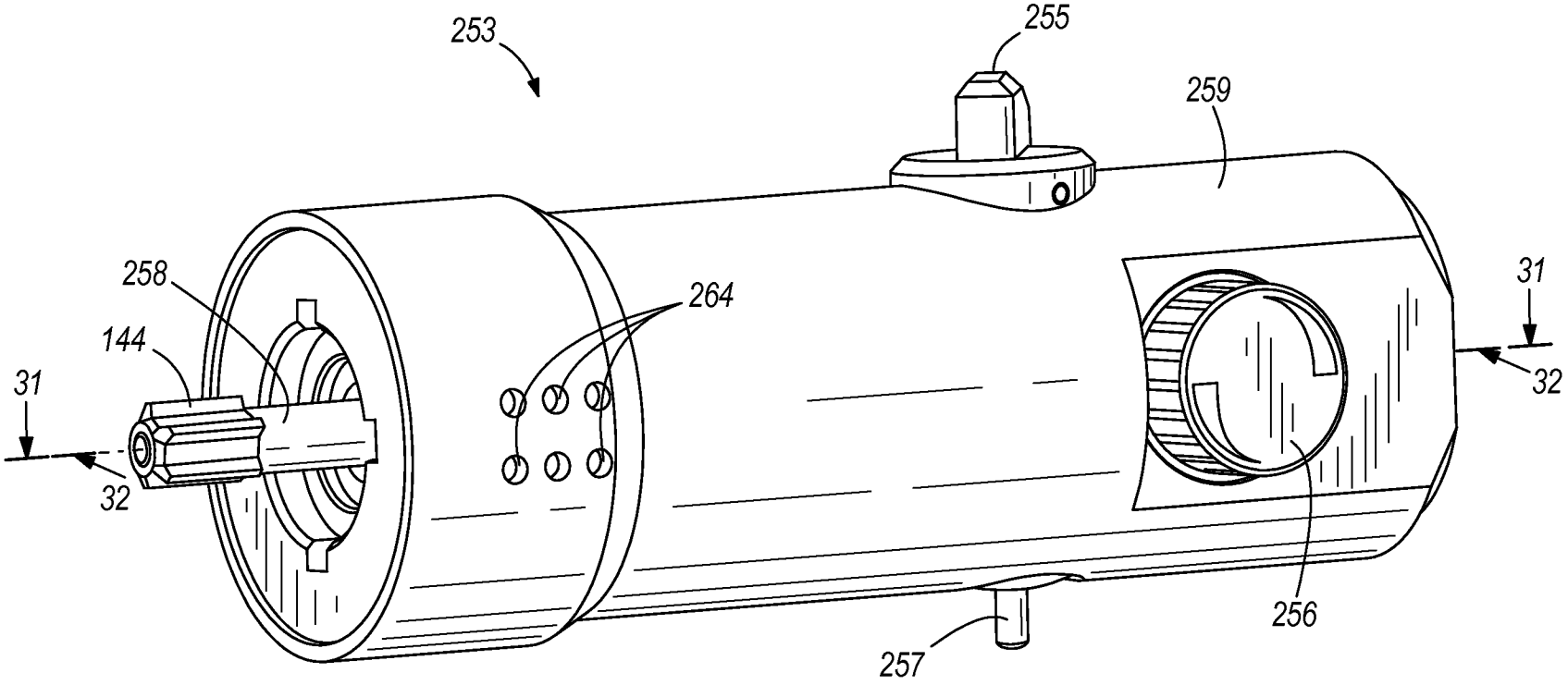
FIG. 30 is a perspective view of a rotary air vane motor for use with the tool handle of FIG. 1.
Figure 31:
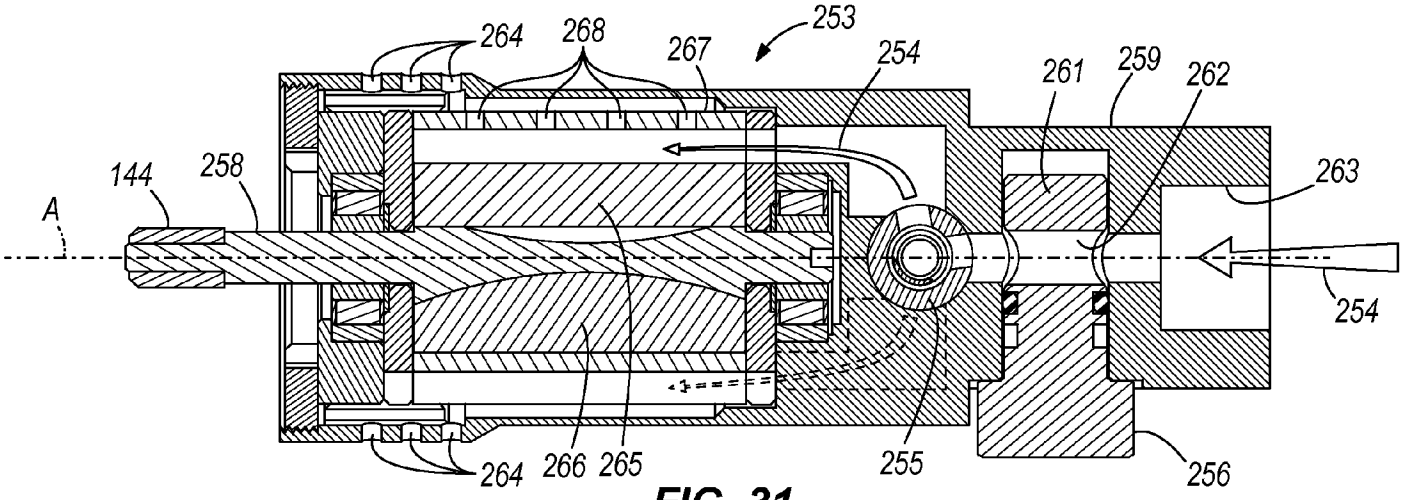
FIG. 31 is a top view of the rotary air vane motor of FIG. 30 with the housing and casing being transparent.
Figure 32:
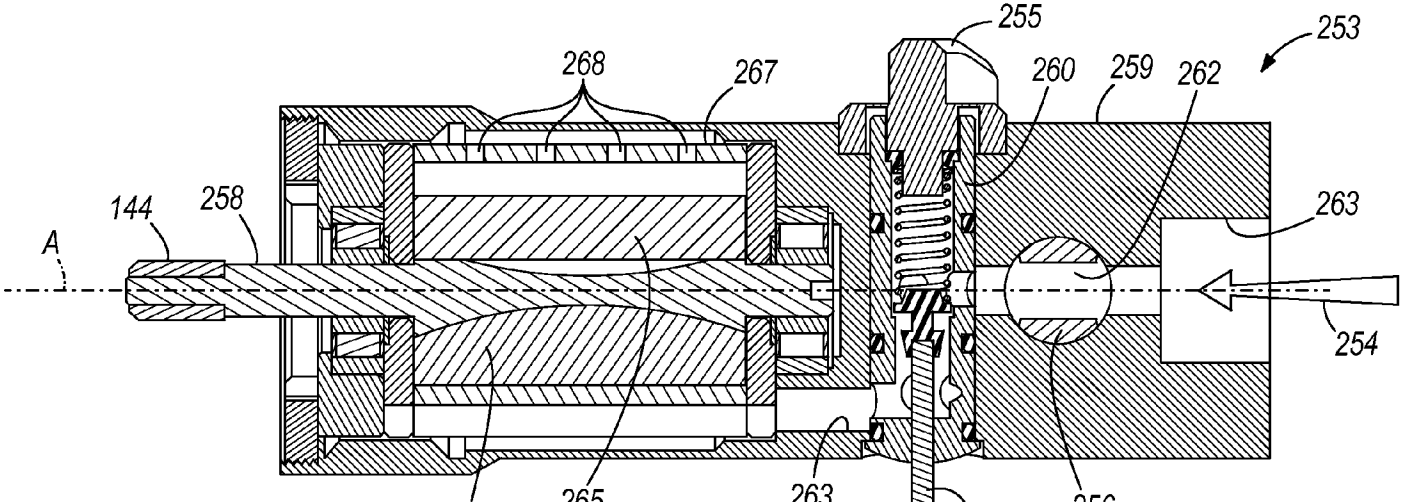
FIG. 32 is a side view of the rotary air vane motor of FIG. 30 with the housing cut out and casing being transparent.
Figure 33:
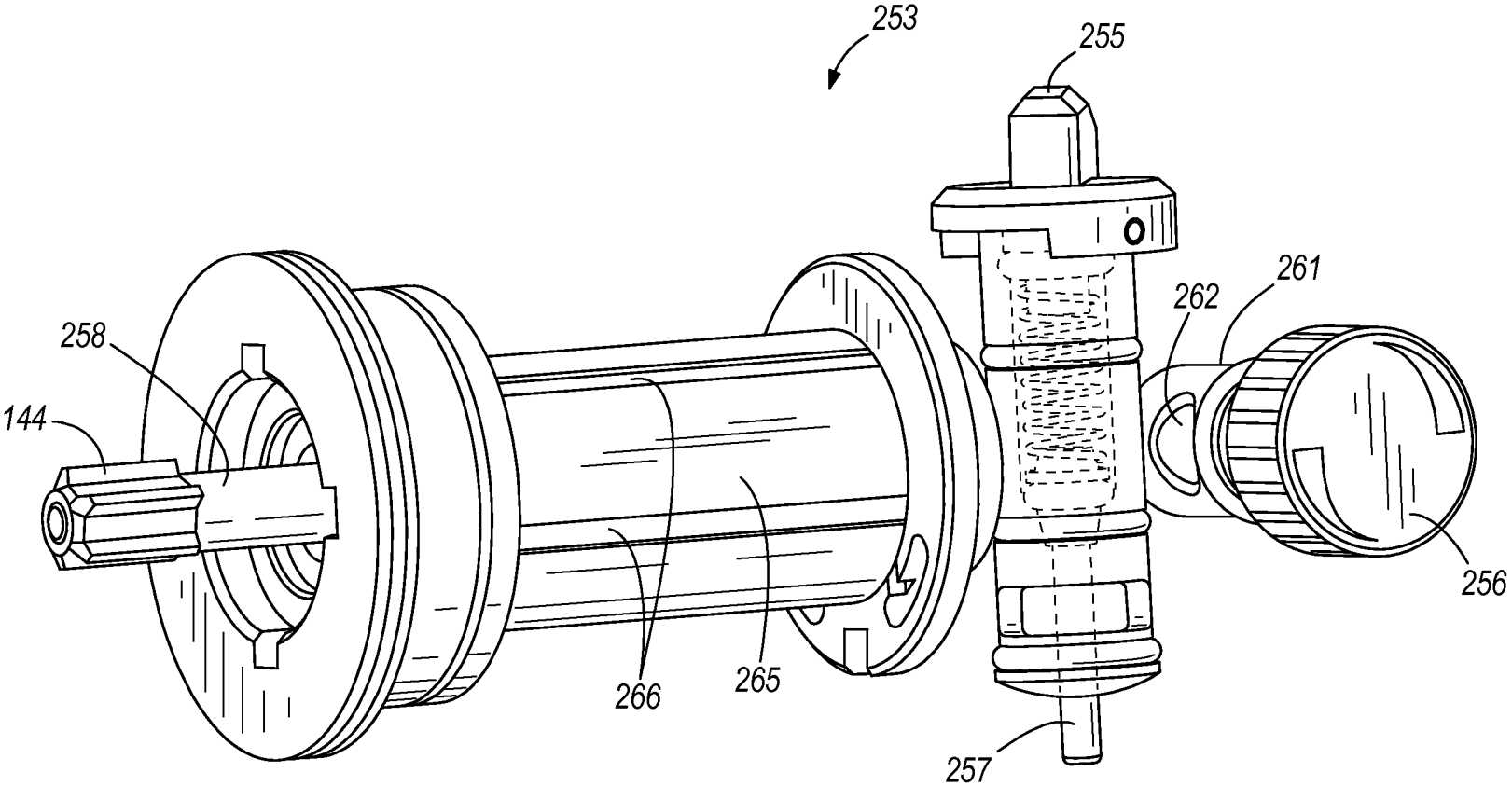
FIG. 33 is a perspective view of the rotary air vane motor of FIG. 30 shown without the housing and casing.

FIGS. 26A and 26B illustrate the ratchet attachment head 110 according to one construction of the invention. The ratchet attachment head 110 is a compact, right angle tool for manipulation in small spaces. The ratchet attachment head 110 includes a drive shank, or ⅜ inch hex head 239, and a dial 240, or forward/reverse knob cover, coupled with a direction knob 241 (FIG. 27). In other constructions, the hex head 239 may be a size smaller or larger than ⅜ inch. As shown in FIG. 26B, the hex head 239 receives a socket adaptor 220 and sockets 222A, 222B. FIG. 27 is an exploded view of the ratchet attachment head 110. FIGS. 28 and 29 are cross sections of the ratchet attachment head 110.

The ratchet attachment head 108 includes a pinion 242 that includes the central opening 134 for receiving the motor drive shaft projection 144 or 145 and transfers rotational motion of the motor 102 to an eccentric shaft 243 by way of a ring gear assembly 244, planetary gears 245 and carrier 246. The eccentric shaft 243 includes a projection 247 that rotates off-center to cause oscillating motion of an adjacent yoke head 248 about an axis E. Oscillating rotational motion of the yoke head 248 is transferred to a single-direction rotational motion of a hex head 239 having a ratchet 249. The ratchet 249 allows for transferring only one direction of the oscillating motion of the yoke head 248 to the hex head 239 such that the hex head 239 rotates in a single direction in operation. The dial 240 and direction knob 241 are rotatable between two positions: a first position allowing rotation of the hex head 239 in a first direction (e.g., forward) and a second position allowing rotation of the hex head 239 in a second direction opposite the first direction (e.g., reverse). The hex head 239 defines the longitudinal axis E, which is perpendicular to the axis A.

The ratchet attachment head 110 is housed within a gear housing 250 and a handle 251. A rubber boot 252 is disposed on an outer surface of the gear housing 250 and the handle 251.

In another construction, the handle 100 may be a pneumatic tool handle 100 powered by pressurized air flow through a rotary air vane motor 253, illustrated in FIGS. 30-33. In this construction, instead of the battery 146 and electric motor 102, the handle 100 includes the rotary air vane motor 253 and a connector (not shown) for receiving pressurized air. The remaining components of the handle 100 remain substantially the same as described above, it being understood that dimensions and geometry are adjustable to accommodate the rotary air vane motor 253, and the similar components will not be described in further detail. However, the handle interface 124 remains the same so as to be connectable to the tool head interface 122 in the same manner as described above. The motor drive shaft projection 144, described above, is coupled to a drive shaft 258 of the rotary air vane motor 253 for mating with the transmission of the attachment heads 104-110, as described above.

In the illustrated construction, the air vane motor 253 is a five vane reversible motor. In other constructions, the air vane motor 253 may include a different number of vanes and need not be reversible. Furthermore, other suitable types of pneumatic motors may be employed.

With reference to FIGS. 30-33, the air vane motor 253 includes a forward/reverse selector 255, a speed selector 256, an actuator 257, a drive shaft 258, a rotor 265 mounted to the drive shaft 258, vanes 266, and a housing 259. Pressurized air enters the motor 253 and expands against the vanes 266 of the air vane motor 253, thus providing a force that causes the rotor 265 and drive shaft 258 to rotate. The drive shaft 258 rotates about the axis A, as described above with respect to the electric motor 102. The motor 253 includes a casing 267 surrounding the rotor 265, the casing 267 including exhaust ports 268 positioned to direct flow away from the vanes 266 in a radial direction. The flow of air 254 enters the motor 253 at the connector (not shown) and exits the motor 253 through side exhaust openings 264 in the housing 259, which are positioned in a direction substantially perpendicular to the axis A. The housing 259 includes passageways 263 between the connector (not shown) and the exhaust openings 264 for directing the flow of air 254 through the motor 253.

The speed selector 256 extends from the housing 249 and is coupled to a speed valve assembly 261 for adjusting the flow of air 254 through the air vane motor 253 such that the speed of the drive shaft 258 is adjustable. The speed selector 256 is rotatable and, in turn, rotates the speed valve assembly 261. The speed valve assembly 261 includes an opening 262 that is rotatable between a first position, in which the opening 262 is substantially aligned with the passageways 263 directing the flow of air 254 through the housing 259, and a second position, or range of positions, in which the opening 262 is partially aligned with the passageways 263, thus restricting the passageways 263. The second position includes a range of positions in which the speed valve assembly 261 variably restricts the flow of air 254 through the housing 259 to adjust the speed of air through the housing 259, thus adjusting the force on the vanes 266 and the output speed of the drive shaft 258.

The forward/reverse selector 255 extends from the housing 259 and is coupled to a direction valve assembly 260 for switching the motor 253 between forward and reverse directions of rotation, as is well understood in the art. The forward/reverse selector 255, and in turn, the direction valve assembly 260, are rotatable between a first position in which the direction valve assembly 260 directs the air such that the drive shaft 258 rotates in a forward direction and a second position in which the direction valve assembly 260 directs the air such that the drive shaft 258 rotates in a reverse direction opposite the forward direction.

The actuator 257 extends from the housing 259 and is movable in an axial direction between a first position in which flow of air 254 to the vanes 266 is allowed and a second position in which flow of air 254 to the vanes 266 is inhibited. The switch trigger 113, described above, is configured to move the actuator 257 to the first position when a user presses the switch trigger 113. The actuator 257 is biased to the second position such that the air vane motor 253 is not actuated.

The housing assembly 114, described above, is adapted to accommodate the rotary air vane motor 253. As described above, the housing assembly 114 includes the housing 138 and the handle interface 124 for mating with the head interface 122.

In operation, various attachment heads 104-110 are coupled with the handle 100 for being driven by the motor 102, 253. Each attachment head provides its own gear train with a particular gear ratio for achieving an appropriate operating speed for that particular attachment head 104-110. The head interface 122 is radially symmetrical and can be divided into four equal parts such that the attachment heads 104-110 may be coupled to the handle 100 in four different rotational orientations positioned about the axis A. As the attachment head 104-110 is coupled with the handle 100, the radial projections 142 are pushed radially inward toward the axis A, against the bias of springs 116, until the openings 132 align with the release buttons 115. The openings 132 receive the release buttons 115 therein by way of the biasing force of the springs 116 to hold the attachment head 104-110 in place relative to the handle 100. At the same time, one of the four pins 128 and the corresponding one of the four cavities 130 mate with the boss 136, the ridges 141 mate with the grooves 140 to align the head 104-110 with the handle 100 in one of the four orientations. The inclusion of four pins 128 and four cavities 130 on the head interface 122 allows the attachment head 104-110 to actuate the button 137, and thereby the lock-off feature, in any of the four orientations. Further, the motor drive shaft projection 144 mates with the central opening 134 to drivingly connect the motor 102 to the attachment head 104-110.

To operate the tool, the operator actuates the switch trigger 113 on the handle, which activates the motor 102 to drive the attachment head 104-110 as long as the attachment head 104-110 is attached to the handle 100 and the button 137 is depressed. When the attachment head 104-110 is not attached to the handle 100, the switch trigger 113 is immobilized by the trigger stop 111 and the motor 102 will not operate. To release the attachment head 104-110, an operator depresses the release buttons 115 toward the axis A and pulls the attachment head 104-110 away from the handle 100 in a direction parallel to the axis A.

Thus, the invention provides, among other things, a multi-function tool system having a universal handle and various attachment heads connectable to the single universal handle. Although the invention has been described in detail with reference to certain preferred embodiments, variations and modifications exist within the scope and spirit of one or more independent aspects of the invention as described.

What is claimed is:

1. A power tool, comprising:

a handle;

a head selectively coupled to the handle;

a motor having a drive shaft extending therefrom, the drive shaft having a first central axis;

an opening for receiving the drive shaft of the motor for transferring rotation of the drive shaft to a tool output, the opening defining a second central axis;

a trigger for activating the motor;

a trigger stop movable between a first position and a second position, wherein in the first position the trigger stop engages the trigger in order to lock the trigger and prevent activation of the motor, and in the second position the trigger is unlocked to permit activation of the motor;

a linkage coupled to the trigger stop, wherein the linkage is positioned at a first radial distance from the first central axis; and a plurality of actuators extending from the head and positioned at a second radial distance from the second central axis, the first radial distance being substantially equal to the second radial distance, wherein when the head is coupled to the handle in a first rotational orientation, one of the plurality of actuators engages the linkage to move the trigger stop to the second position, and when the head is coupled to the handle in a second rotational orientation different from the first rotational orientation, another one of the plurality of actuators engages the linkage to move the trigger stop to the second position.

2. The power tool of claim 1, wherein the plurality of actuators extend substantially parallel to the second central axis, and wherein the linkage is movable in a direction substantially parallel to the first central axis between a first position in which the trigger is locked and a second position in which the trigger is unlocked.

3. The power tool of claim 1, wherein the plurality of actuators includes four actuators spaced about the second central axis approximately 90 degrees apart such that the head is coupleable to the handle in four rotational orientations.

4. The power tool of claim 1, wherein the handle further includes a projection extending radially outward from the first central axis and wherein the tool head further includes an opening for receiving the projection, wherein the projection is biased radially outwardly for being received by the opening when the tool head is coupled to the tool handle, and wherein the projection is depressible for selectively releasing the tool head from the tool handle.

5. The power tool of claim 1, further comprising:

ridges associated with one of the handle and the head, the ridges extending substantially parallel to one of the first and second central axes; and grooves associated with the other of the handle and the head, the grooves extending substantially parallel to the other of the first and second central axes for receiving the ridges and locating the head in one of the first and second rotational orientations.

* * * * *